US009327387B2

(12) United States Patent
Shah et al.

(10) Patent No.: US 9,327,387 B2
(45) Date of Patent: May 3, 2016

(54) INTEGRATED FOOT VISE AND WRENCH

(71) Applicant: Emerson Electric Co., St. Louis, MO (US)

(72) Inventors: Vineet S. Shah, Pimpri (IN); Sachin Dakare, Katraj (IN); James E. Hamm, Grafton, OH (US)

(73) Assignee: Emerson Electric Co., St. Louis, MO (US)

( * ) Notice: Subject to any disclaimer, the term of this patent is extended or adjusted under 35 U.S.C. 154(b) by 334 days.

(21) Appl. No.: 13/964,151

(22) Filed: Aug. 12, 2013

(65) Prior Publication Data

US 2014/0061988 A1 Mar. 6, 2014

(30) Foreign Application Priority Data

Aug. 30, 2012 (IN) ..... 2524/MUM/2012

(51) Int. Cl.

| | |
|---|---|
| ***B25B 1/00*** | (2006.01) |
| ***B25B 3/00*** | (2006.01) |
| ***B25B 1/24*** | (2006.01) |
| ***B25B 1/20*** | (2006.01) |
| ***B25B 5/00*** | (2006.01) |
| ***B25B 5/14*** | (2006.01) |
| ***B25B 13/50*** | (2006.01) |
| ***B25B 13/16*** | (2006.01) |

(52) U.S. Cl.

CPC ... *B25B 3/00* (2013.01); *B25B 1/20* (2013.01); *B25B 1/24* (2013.01); *B25B 1/2484* (2013.01); *B25B 5/006* (2013.01); *B25B 5/147* (2013.01); *B25B 13/16* (2013.01); *B25B 13/5058* (2013.01)

(58) Field of Classification Search

USPC ..... 269/4

See application file for complete search history.

(56) References Cited

U.S. PATENT DOCUMENTS

| | | | | | |
|---|---|---|---|---|---|
| 820,651 | A | * | 5/1906 | Lanham | B25B 13/5058 81/103 |
| 1,075,878 | A | * | 10/1913 | Urquhart | B25B 13/5058 81/105 |
| 1,178,110 | A | * | 4/1916 | Stewart | B25B 13/5058 81/100 |
| 1,308,353 | A | * | 7/1919 | Haman | B25B 13/5058 81/105 |
| 1,336,755 | A | | 4/1920 | Parmelee | |
| 1,345,983 | A | * | 7/1920 | Bell | B25B 13/12 81/106 |
| 1,450,083 | A | * | 3/1923 | Hooper | B25B 7/10 81/159 |
| 1,492,478 | A | * | 4/1924 | Markovich | B25B 13/12 81/103 |

(Continued)

FOREIGN PATENT DOCUMENTS

TW EP 1473118 A1 * 11/2004 ..... B25B 13/5058

OTHER PUBLICATIONS

Chinese Office Action, Application 201310384873.2; Feb. 27, 2015; 30 Pages.

(Continued)

*Primary Examiner* — Lee D Wilson
*Assistant Examiner* — Alvin Grant
(74) *Attorney, Agent, or Firm* — Mark E. Bandy; Rankin, Hill & Clark LLP

(57) ABSTRACT

Tools having provisions associated with a wrench and a vise are described. The tools can include lateral support members extending from the handle that increase stability during use as a vise. The support members can be removed and/or placed in a non-use position when the tool is used as a wrench. The tool can also include support plates that provide a clearance space between a workpiece and a movable jaw of the tool. Various other features of the tools are described.

32 Claims, 22 Drawing Sheets

(56) References Cited

U.S. PATENT DOCUMENTS

| | | | | | |
|---|---|---|---|---|---|
| 1,602,619 | A * | 10/1926 | Larson | B25B 13/16 | 81/104 |
| 1,803,198 | A * | 4/1931 | Maris | B25B 7/04 | 81/356 |
| 1,811,452 | A * | 6/1931 | Blalock | B25B 13/12 | 81/354 |
| 1,941,889 | A * | 1/1934 | Freeman | B25B 13/00 | 248/127 |
| 2,076,830 | A | 4/1937 | Thewes | | |
| 2,102,287 | A * | 12/1937 | Smethers | B25B 7/12 | 81/167 |
| 2,691,317 | A * | 10/1954 | Olson | B25B 13/18 | 81/325 |
| 2,971,411 | A | 2/1961 | Dull | | |
| 3,320,836 | A * | 5/1967 | Hagerman | B25B 13/00 | 269/4 |
| 3,578,307 | A | 5/1971 | Lock et al. | | |
| 3,858,467 | A | 1/1975 | Evans | | |
| 4,151,764 | A * | 5/1979 | Bunn | B25B 13/10 | 81/100 |
| 4,903,555 | A | 2/1990 | Howard | | |
| 4,942,790 | A * | 7/1990 | Wang | B25B 13/14 | 81/133 |
| 5,138,912 | A * | 8/1992 | Dyke | B25B 7/123 | 81/356 |
| 5,791,213 | A | 8/1998 | Young | | |
| 6,202,516 | B1 | 3/2001 | Kim | | |
| 6,523,818 | B1 | 2/2003 | Le Vert et al. | | |
| 6,810,775 | B2 | 11/2004 | Yang | | |
| 7,305,909 | B2 | 12/2007 | Bollinger | | |
| 2007/0245861 | A1 * | 10/2007 | Shields | B25G 1/105 | 81/180.1 |

OTHER PUBLICATIONS

"Proper Use of Pipe Wrenches", RIDGID, http://www.ridgid.com/ASSETS/49413608655C412F8E7E3BD491795998/ProperUseOfPipeWrenches.pdf; 9 pages; Oct. 2005.

* cited by examiner

INTEGRATED FOOT VISE AND WRENCH

FIELD

The present subject matter generally relates to tools and devices such as vises, wrenches and the like.

BACKGROUND

Vises are typically used for holding or clamping a workpiece to allow work to be performed on the workpiece with tools such as saws, planes, drills, mills, screwdrivers, sandpaper and the like. Generally, vises have a fixed jaw and a movable jaw which can be moved towards or away from the fixed jaw. Wrenches are typically used to grip workpieces and provide a mechanical advantage in applying torque to rotate workpieces, such as during engagement of rotary fasteners and the like, or prevent such components from rotating.

In certain applications, a user may require both a vise and/or a wrench. However, tool or hardware costs increase when a jobsite or user is required to provide both tools. Further, carrying multiple tools imposes additional demands on users, particularly if such tools must be transported to a remote location in the field.

It is common to use a pipe vise and a pipe wrench when assembling/disassembling pipe and fittings, cutting and threading pipe, and performing other pipe work. Additionally, it is known to use two pipe wrenches when assembling/disassembling pipe and fittings, and other pipe work. These operations are typically performed in a shop setting, in the field, or at an installation site. The pipe vise and pipe wrench combination is most commonly used in the shop and in the field. The two pipe wrench combination is used in all settings, but is typically used in the field and at installation sites. When using a vise, the vise is typically mounted to a bench or on another support surface to provide stability and resistance to torque applied during the operation(s). When using two pipe wrenches at lower torque, the user grips each wrench and applies force in opposing directions.

When using two pipe wrenches at higher torques, in certain applications one wrench is placed on the ground and the user applies force to the other wrench and a workpiece towards the ground, up to their body weight. However, the resulting assembly of workpiece and wrenches can be difficult to maintain during torque application. As a result, various attempts have been made by artisans to promote stability of the wrench on the ground.

For example, U.S. Pat. No. 5,791,213 discloses a pipe wrench stand that is an accessory in the form of a stand on which a conventional wrench can be mounted for use as a vise. However, when used as a vise, a wrench is positioned upside down in the stand. This makes it difficult to adjust the nut on the wrench. In any event, two separate devices need to be carried or transported by a user, i.e., a wrench and the stand. Additional or at least similar difficulties are associated with vises or pipe wrench stands disclosed in U.S. Pat. Nos. 1,336,755; 2,971,411; 3,320,836; 3,578,307; and 6,523,818.

In addition, several tools are available in the market for gripping pipe against reacting torque. These tools have limited use because they can only be used to grip pipes having specific sizes. The tools cannot be used for other wrench applications. Accordingly, there is need for a tool that can provide functions of both a vise and a wrench.

SUMMARY

The difficulties and drawbacks associated with previously known tools and devices are addressed in the present apparatus and related methods for an integrated foot vise and wrench.

In one aspect, the present subject matter provides a tool for selectively gripping a workpiece. The tool comprises a handle including a sleeve at one end and an opposite distal end. The sleeve defines a receiving region. The tool also comprises a fixed jaw adjoined to at least one of the sleeve and the handle. The tool additionally comprises a movable jaw defining a shank. The movable jaw is movably disposed in the receiving region defined in the sleeve. The movable jaw defines a threaded region along at least a portion of the shank. The movable jaw is positioned relative to the fixed jaw so as to define a workpiece engaging region between the fixed jaw and movable jaw accessible from a front of the tool and rearwardly bounded by the movable jaw. The tool also comprises a rotatable threaded member retained to at least one of the handle and the sleeve. The threaded member is threadedly engaged with the threaded region of the movable jaw such that rotation of the threaded member results in linear displacement of the movable jaw relative to the fixed jaw. And, the tool comprises at least one lateral support member extending outward from the handle and extending at an angle within a range of 0° to 20° toward a rear of the tool.

In another aspect, the present subject matter provides a tool for selectively gripping a workpiece. The tool comprises a handle including a sleeve at one end and an opposite distal end. The sleeve defines a receiving region. The tool also comprises a fixed jaw adjoined to at least one of the sleeve and the handle. The tool additionally comprises a movable jaw defining a shank. The movable jaw is movably disposed in the receiving region defined in the sleeve. The movable jaw defines a threaded region along at least a portion of the shank. The movable jaw is positioned relative to the fixed jaw so as to define a workpiece engaging region between the fixed jaw and movable jaw accessible from a front of the tool and rearwardly bounded by the movable jaw. The tool also comprises a rotatable threaded member retained to at least one of the handle and the sleeve. The threaded member is threadedly engaged with the threaded region of the movable jaw such that rotation of the threaded member results in linear displacement of the movable jaw relative to the fixed jaw. And, the tool also comprises a first and a second support plate. Each support plate is engaged with at least one of the sleeve and the fixed jaw. The first support plate is positioned adjacent to a first side of the tool and the second support plate is positioned adjacent to a second side of the tool. The second side is oppositely directed from the first side. Each support plate defines a frontwardly directed edge, wherein the frontwardly directed edges of the first and the second support plates are spaced from a face of the movable jaw that rearwardly bounds the workpiece engaging region. The frontwardly directed edges serve to support a workpiece when disposed in the workpiece engaging region.

In still another aspect, the present subject matter provides a system selectively configurable between a vise configuration and a wrench configuration. The system comprises a tool for selectively gripping a workpiece. The tool includes (i) a handle including a sleeve at one end and an opposite distal end, the sleeve defining a receiving region, (ii) a fixed jaw adjoined to at least one of the sleeve and the handle, (iii) a movable jaw defining a shank, the movable jaw movably disposed in the receiving region defined in the sleeve, the movable jaw defining a threaded region along at least a portion of the shank, the movable jaw positioned relative to the fixed jaw so as to define a workpiece engaging region between the fixed jaw and movable jaw accessible from a front of the tool and rearwardly bounded by the movable jaw, (iv) a rotatable threaded member retained to at least one of the handle and the sleeve, the threaded member threadedly engaged with the threaded region of the movable jaw such that rotation of the threaded member results in linear displacement of the movable jaw relative to the fixed jaw, and (v) at least one lateral support member. Upon being configured in a vise configuration the at least one lateral support member is engaged to the handle and extends outward from the handle. Upon being configured in a wrench configuration, the at least one lateral support member is disengaged from the handle.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

Figure 1:
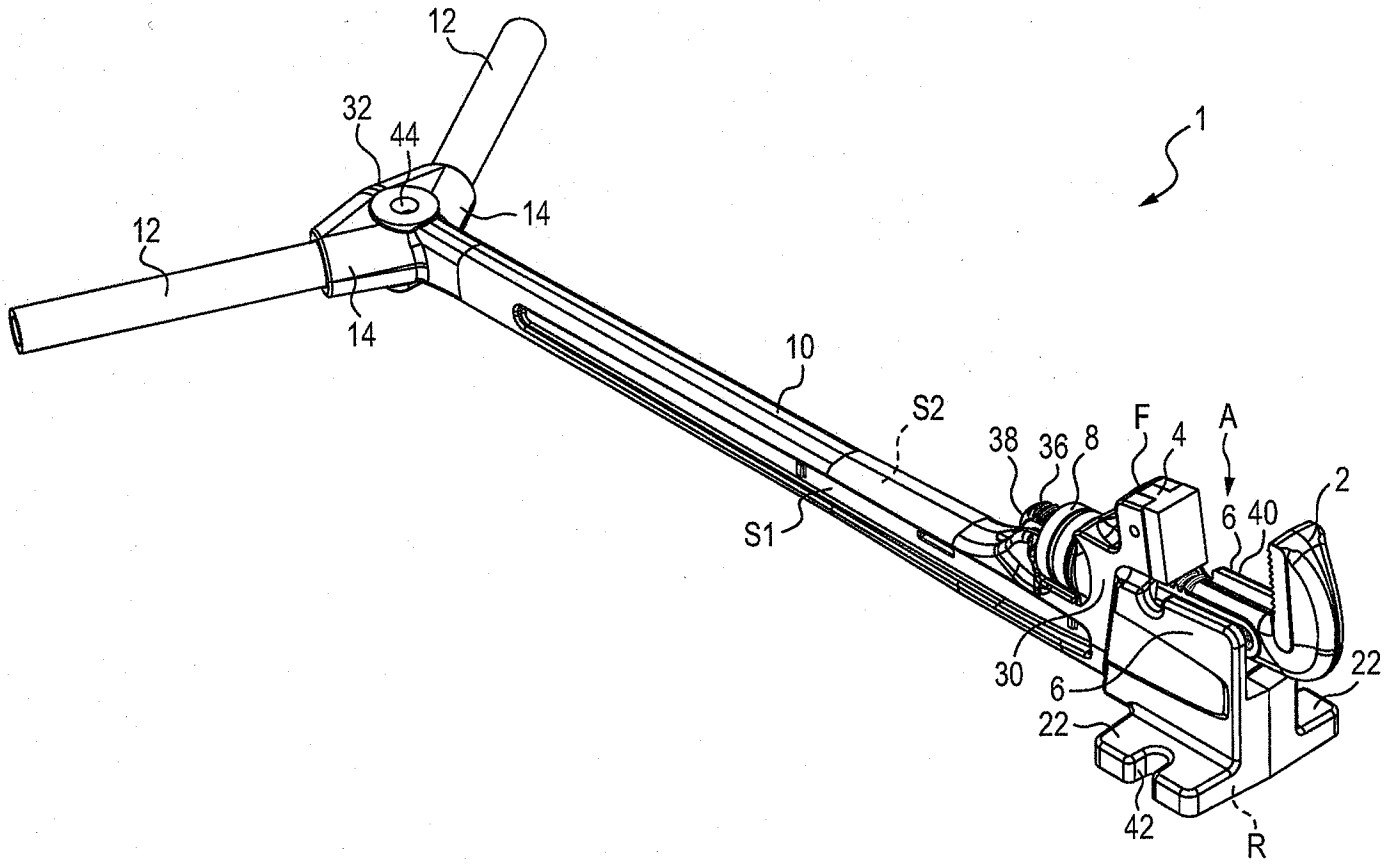
FIG. 1 illustrates a perspective view of an integrated foot vise and wrench, in accordance with an embodiment of the present disclosure.

The disclosure will now be described with reference to the accompanying drawings which do not limit the scope and ambit of the disclosure. The description provided is purely by way of example and illustration.

The embodiments herein and the various features and advantageous details thereof are explained with reference to the non-limiting embodiments in the following description. Descriptions of well known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The description hereinafter, of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

The present subject matter provides a tool that has provisions enabling its use as both a vise and a wrench. The vise and wrench provisions are integral or at least partially integral with the tool. In certain versions, the tool also includes removable stability promoting members. In additional versions of the tools, workpiece support members are provided to space a workpiece when disposed in a workpiece engaging region, from a movable jaw to facilitate positional adjustment of that jaw and to preclude application of loads or forces to a shank portion of the movable jaw. In still additional versions of the tools, one or more mounting provisions are provided for affixing the tool to a support member or base, such as by using for example threaded fastener assemblies such as bolts and nuts. In particular embodiments, the present subject matter provides a system that is selectively configurable between a vise configuration and a wrench configuration. The system comprises a tool as generally described herein. Upon being configured in a vise configuration one or more lateral support member(s) are engaged to the handle and extend outwardly therefrom. Upon being configured in a wrench configuration the one or more support member(s) are disengaged from the handle and can conveniently be stowed alongside the handle. These and other aspects are described in greater detail as follows.

FIGS. 1-5 illustrate an integrated foot vise and wrench 1 in accordance with the present subject matter. The tool 1 comprises a handle 10, a fixed jaw or heel jaw 4, a movable jaw or hook jaw 2, a rotatable threaded member or nut 8, workpiece support provisions 6, stability promoting provisions 12, and mounting provisions 22.

Specifically, the handle 10 includes a sleeve 30 at a one end and an opposite distal end 32. The sleeve defines a hollow or recessed receiving region 34 (best shown in FIG. 3) adapted to receive the movable jaw 2 as described in greater detail herein.

The fixed heel jaw 4 is adjoined, or in certain embodiments integrally formed with, at least one of the sleeve 30 and the handle 10. Generally, the fixed jaw includes a workpiece engaging face which may define a plurality of ridges or serrations. Alternatively, the face may be flat or finished.

The movable hook jaw 2 includes a shank 38 and is movably disposed in the receiving region 34 defined in the sleeve 30. The movable jaw 2 defines a threaded region 36 along at least a portion of the shank 38. The movable jaw 2 is positioned relative to the fixed jaw 4 so as to define a workpiece engaging region A between the fixed jaw 4 and the movable jaw 2 that is accessible from a front of the tool rearwardly bounded by the movable jaw 2 and/or the shank 38 of the jaw 2. Generally, the movable jaw includes a workpiece engaging face which may define a plurality of ridges or serrations. Alternatively, the face may be flat or finished.

At this juncture, it is instructive to consider several designations as follows. In the tools disclosed herein, the front of the tool is the region of the tool at which the workpiece engaging region is most accessible. For example, for the tool 1 shown in FIGS. 1-5, the front F of the tool is shown in FIGS. 1-3 and 5. The front F of the tool 1 is the region of the tool at which the workpiece engaging region A is most accessible. A rear of the tool 1 is shown as rear R in FIGS. 1 and 5 for example. The rear R of the tool is generally oppositely directed from the front F of the tool. The rear of the tool is generally oppositely directed from the workpiece engaging region. The tool 1 also defines oppositely directed lateral sides S1 and S2 between the front F and rear R. The sides S1 and S2 are shown in FIGS. 1-5.

As noted, the tool 1 includes the rotatable threaded member or nut 8. Rotation of the nut 8 serves to adjust the distance between the movable jaw 2 and the fixed jaw 4. The rotatable member 8 is rotatably retained to at least one of the handle 10 and the sleeve 30. Thus, the nut 8 can be rotated while being retained or secured to one or both of the handle and the sleeve. The rotatable member 8 is also threadedly engaged with the threaded region 36 of the movable jaw 2 such that rotation of the threaded member results in linear displacement of the movable jaw 2 relative to the fixed jaw 4. In the tool 1 depicted in FIGS. 1-5, the rotatable member 8 is located along or accessible from the front region F of the tool. However, as described herein, the present subject matter also includes tools having rotatable members along or accessible from rear regions of the tool.

In many of the tools of the present subject matter, one or more biasing members or springs are provided in association with the movable jaw 2. The spring(s) are positioned in the sleeve or housing area of the tool so as to allow the movable jaw of the tool to pivot relative to the handle and fixed jaw and thereby permit the known ratchet or pipe wrench action well known in the art. This is described in greater detail in U.S. Pat. Nos. 1,552,091 and 1,549,164 for example.

Figure 2:
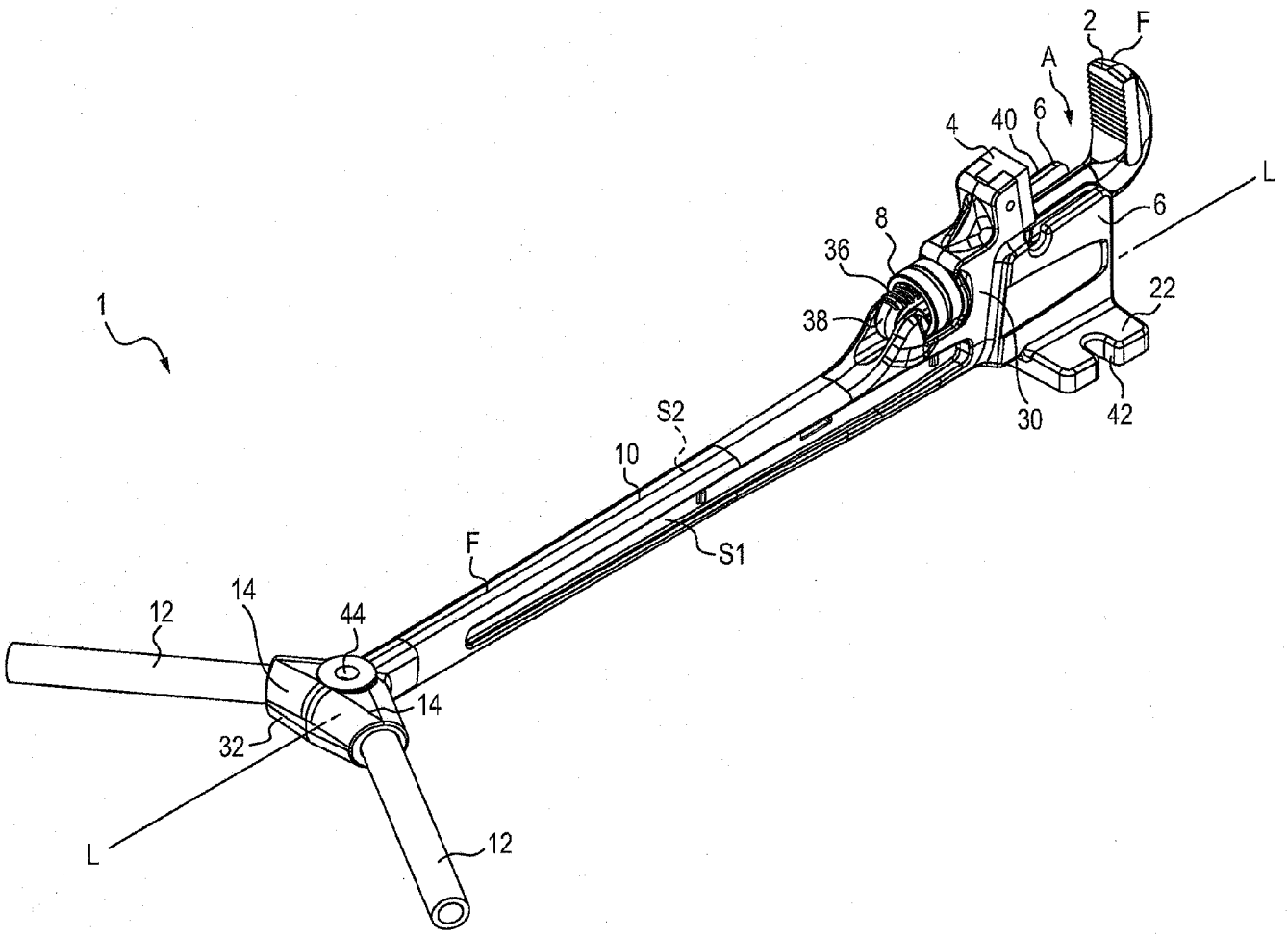
FIG. 2 illustrates another perspective view of the integrated foot vise and wrench of FIG. 1.
Figure 3:
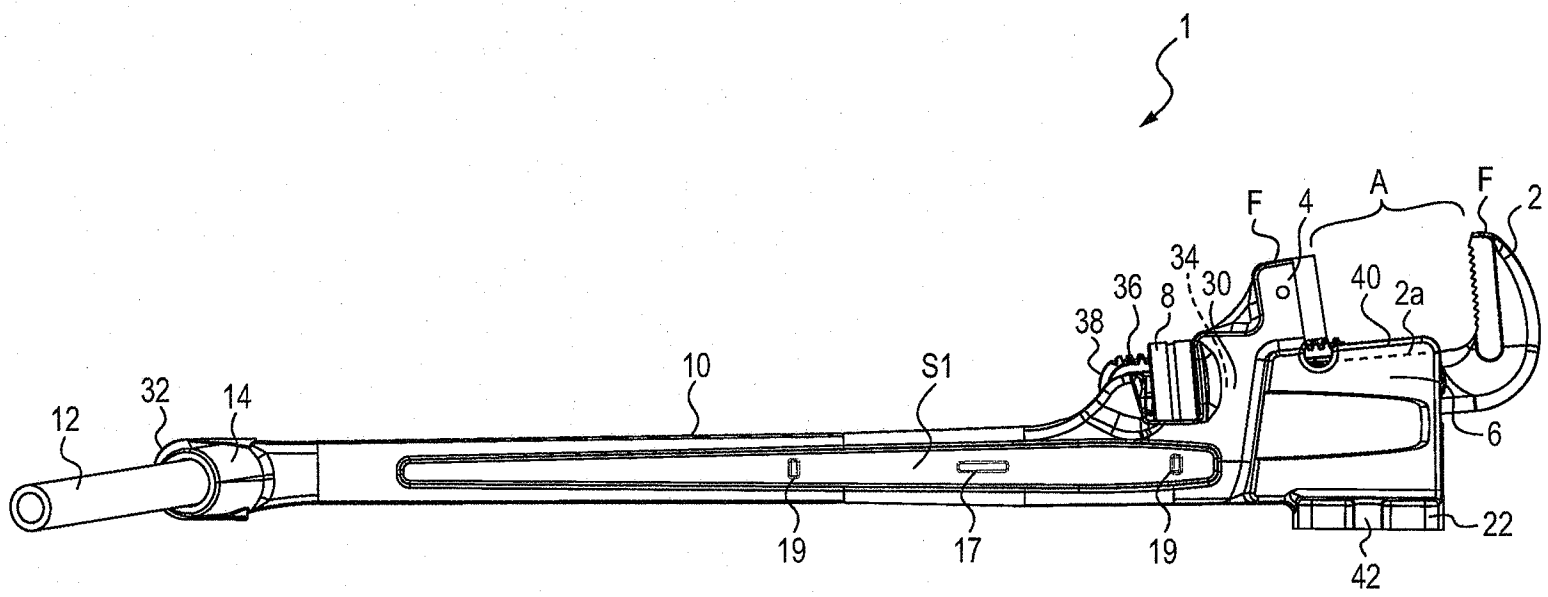
FIG. 3 illustrates a side elevational view of the integrated foot vise and wrench of FIG. 1.
Figure 4:
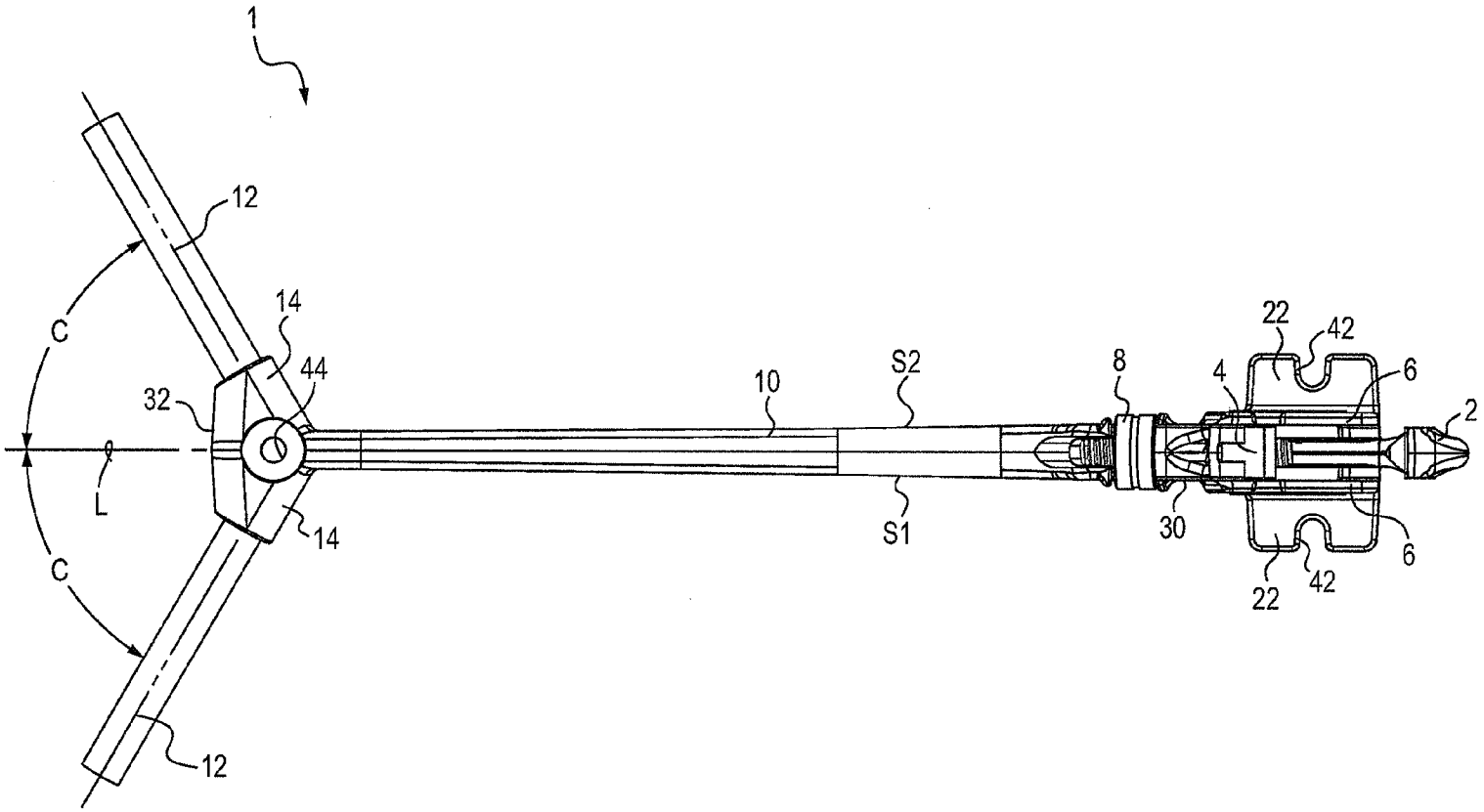
FIG. 4 illustrates a front view of the integrated foot vise and wrench of FIG. 1.
Figure 5:
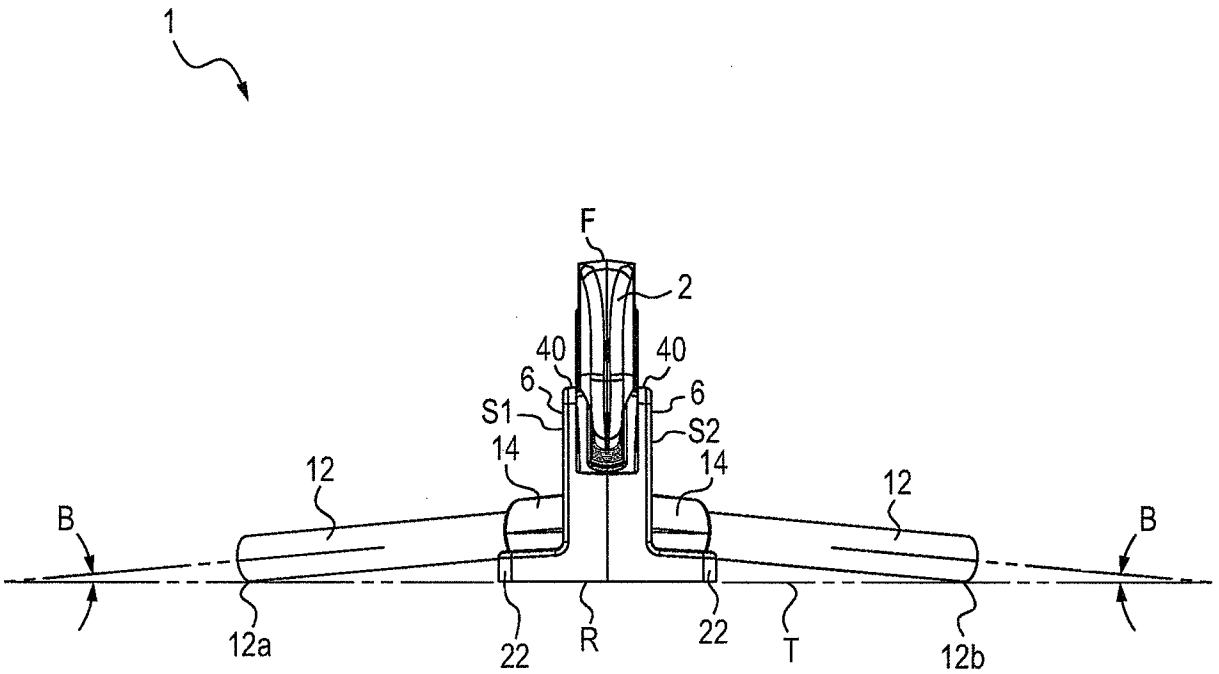
FIG. 5 illustrates an end view of the integrated foot vise and wrench of FIG. 1.

In the particular embodiment of tool 1 depicted in FIGS. 1-5, the stability promoting provisions 12 are in the form of at least one lateral support member that extends outward from the handle 10. In certain versions, the outwardly extending member(s) extend at an angle within a range of 0° to 60° and more particularly 0° to 20° toward a rear of the tool. Referring to FIG. 5, a rearward orientation of the support members 12 is shown. The rearward angular orientation is shown in FIG. 5 as angle B. Angle B is taken between an axis or centerline of a support member 12 and a plane that extends along a rearward region of the tool. Specifically, that plane is depicted in FIG. 5 as plane T. Plane T is defined as a plane that extends along a rearward region of the tool, and intersects points of contact 12*a* and 12*b* with the support members 12. The points of contact 12*a* and 12*b* are the distal most end regions of the support members 12 that contact the ground or other support surface. The plane T also extends generally parallel to a longitudinal axis L of the tool such as depicted in FIG. 2. The plane T may coincide with and/or be parallel to a rearward face R of the tool 1. Although the present subject matter includes a range of orientation angles for the support members, i.e., angle B, a particular range is from 5° to 15°. In certain embodiments, angle B is 6°. The support members 12 may also extend laterally outward in a direction generally parallel with the rearward face R of the tool. In many applications, it is beneficial that the support members extend toward a rear of the tool. As described in greater detail herein, when such a configuration is used, three points of contact occur between the tool and the ground or other support surface.

The lateral support members such as support members 12 may include one, two, three, four or more support members. In the version of the tool 1 shown in FIGS. 1-5, two support members 12 are utilized.

The lateral support members may also be oriented at particular angular positions with respect to the handle or other portions of the tool 1. In the particular embodiment shown in FIGS. 1-5, each support member 12 is also directed toward the distal end 32 of the handle and oriented at an angle relative to a longitudinal axis L of the handle 10 (see FIG. 2) within a range of from 90° to 10°. This angle is depicted in FIG. 4 as angle C. Although a range of angles are contemplated, in certain versions, angle C is from about 45° to about 75°, and in particular versions about 60°. Typically, the support members are directed toward the handle distal end, however, the present subject matter includes tools having the support members extending outward and toward a working end of the tool, i.e., toward the jaws.

The support members 12 are generally located toward or proximate the distal end 32 of the handle 10. However, the present subject matter includes versions in which the members 12 are located closer to the working end of the tool, i.e. the end at which the jaws 2, 4 are located. The members 12 may also be located at a region midway along the length of the handle.

The support members 12 can be permanently attached or coupled to the tool 1 such as attached to the handle 10. Alternatively, the support members 12 can be removable from the tool 1. A wide array of provisions and assemblies can be used to provide a releasable engagement between the support members 12 and the tool. In the tool 1 of FIGS. 1-5, corresponding adapters 14 are provided which releasably engage a respective support member 12. For example, threaded end regions can be provided on each of the support members 12 and recessed or apertured threaded receiving regions can be provided in the adapters 14 for receiving and engaging ends of the support member 12. The present subject matter includes an array of releasable engagement provisions such as detents in the members or adapters with corresponding apertures in the other component, frictionally engaged male and female end regions in the components, and various mechanical assemblies.

As noted, the tool 1 also includes a workpiece support 6. In the particular version of the tool 1 shown in FIGS. 1-5, the workpiece support 6 includes two plates or similar members that extend toward the front of the tool along opposite sides or regions toward and/or proximate the workpiece engaging region A. Each support plate 6 is engaged or integrally formed with at least one of the sleeve 30 and the fixed jaw 4. Specifically, a first support plate 6 is positioned adjacent or alongside a first side S1 of the tool 1, and a second support plate 6 is positioned adjacent or alongside a second side S2 of the tool 1. Each support plate 6 defines a frontwardly directed edge 40. In certain versions of the tools, the frontwardly directed edges 40 of the support plates 6 are forwardly spaced from a forwardly directed face of the moveable jaw 2 or shank portion 38 thereof. This is shown in FIG. 3 in which the edge 40 extends beyond a forwardly directed face 2*a* of the movable jaw 2. The frontwardly directed edge(s) 40 serve to contact and provide an extended support region for a workpiece when the workpiece is positioned between the jaws and within the workpiece engaging region A.

Generally, the workpiece support members or plates 6 are permanently attached to or integrally formed with the tool such as at the working end of the handle 10 and proximate the jaws 2, 4. However, the present subject matter includes versions in which the workpiece support members 6 are releasable or detachable from the tool.

As noted, the tool 1 may also comprise one or more mounting provisions or ears 22. In the particular embodiment shown in FIGS. 1-5, each mounting ear 22 extends laterally outward from at least one of the handle 10 and the sleeve 30. A first ear 22 projects from side S1 of the tool 10 and a second ear 22 projects from side S2 of the tool 10. Each mounting ear 22 typically defines at least one opening or aperture 42 extending at least partially through the thickness of the ear. The opening or aperture 42 can also be in the form of a slot or recess accessible from an edge of the ear such as shown in FIGS. 1-5. The apertures 42 can also define threads along their interior surfaces for engagement with threaded fasteners.

In certain versions, the tool 1 also includes mounting provisions in the form of at least one opening or aperture 44 at or proximate the distal end 32 of the handle 10. The opening or aperture 44 extends at least partially through the thickness of the handle 10. In the embodiment shown in FIGS. 1-5, the aperture 44 is located within the adapters 14. However, the present subject matter includes various other locations and configurations for the mounting aperture 44. The opening or aperture 44 can also be in the form of a slot or recess accessible from an end or edge of the handle 10 or adapters 14. The aperture 44 can also define threads along an interior face for engagement with threaded fasteners.

FIG. 3 also illustrates a slot or aperture 17 defined in the handle 10. FIG. 3 additionally depicts one or more outwardly projecting nubs 19 which can be provided along one or both sides S1 and S2 of the handle. In certain versions of the tools, nubs 19 are provided along both sides of the handle 10 and are configured to receive and retain the support members 12 when the support members 12 are detached or removed from their corresponding adapters 14. Generally, the nubs are spaced apart from one another by a distance that is at least as great as the length of a support member. Thus, upon securing a support member alongside the handle such as by use of a strap, the nubs prevent the support member from sliding lengthwise out of the strap. In particular embodiments, the nubs 19 are configured and spaced from one another so as to releasably and frictionally engage a support member 12 when positioned alongside the handle 10 and between the nubs 19. Upon appropriately positioning the support members 12 alongside the handle 10 and between the nubs 19, a flexible strap, band, wire, cords, or other member can be inserted through the aperture 17 and wrapped around the support members 12 while in their stowed position. In certain versions, the strap is in the form of a woven nylon strap with corresponding regions of "hook" and "loop" material (also known as VELCRO) at its ends or other regions. The strap may or may not be attached to the handle.

Figure 6:
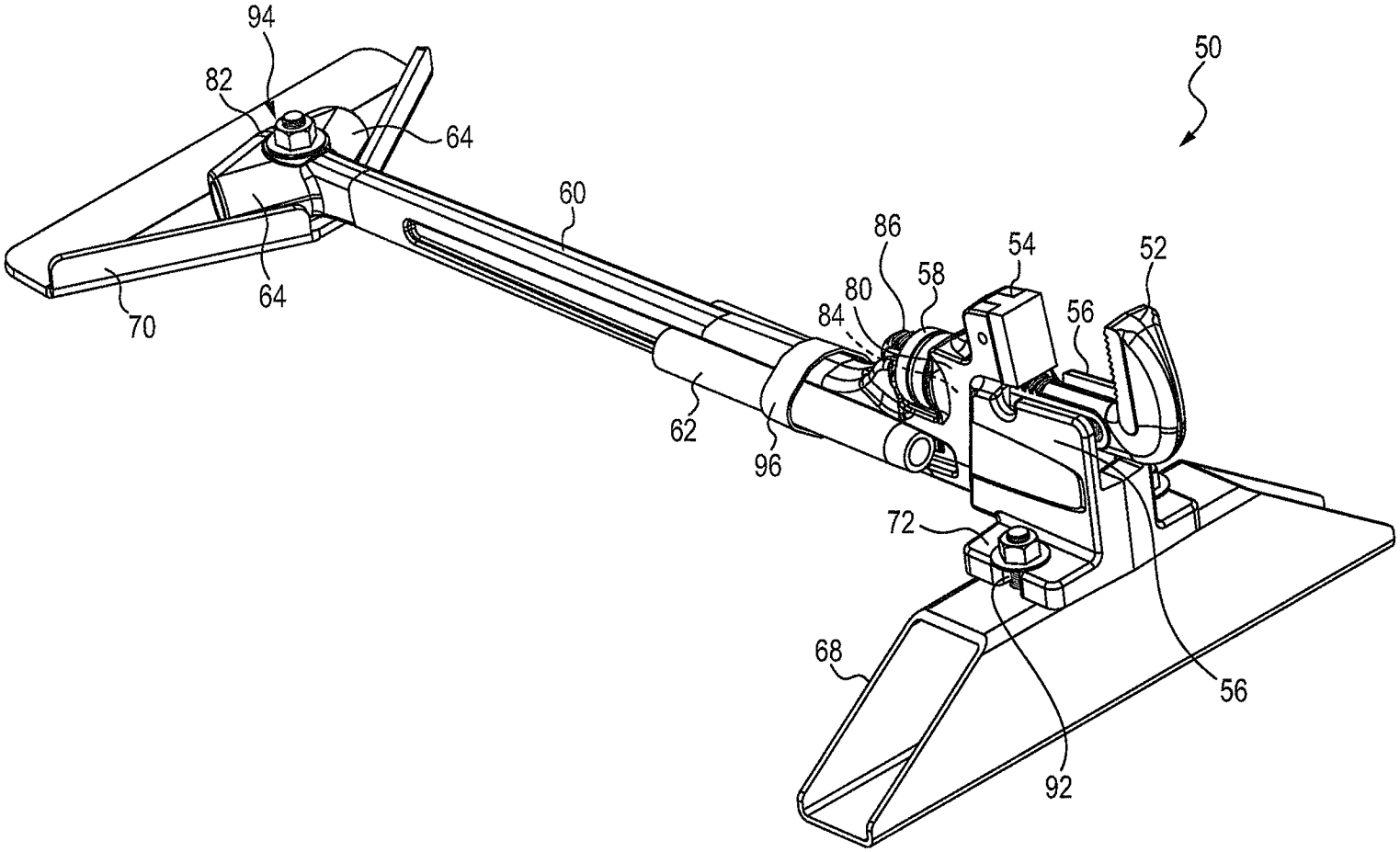
FIG. 6 illustrates a perspective view of an integrated foot vise and wrench, in accordance with another embodiment of the present disclosure
Figure 7:
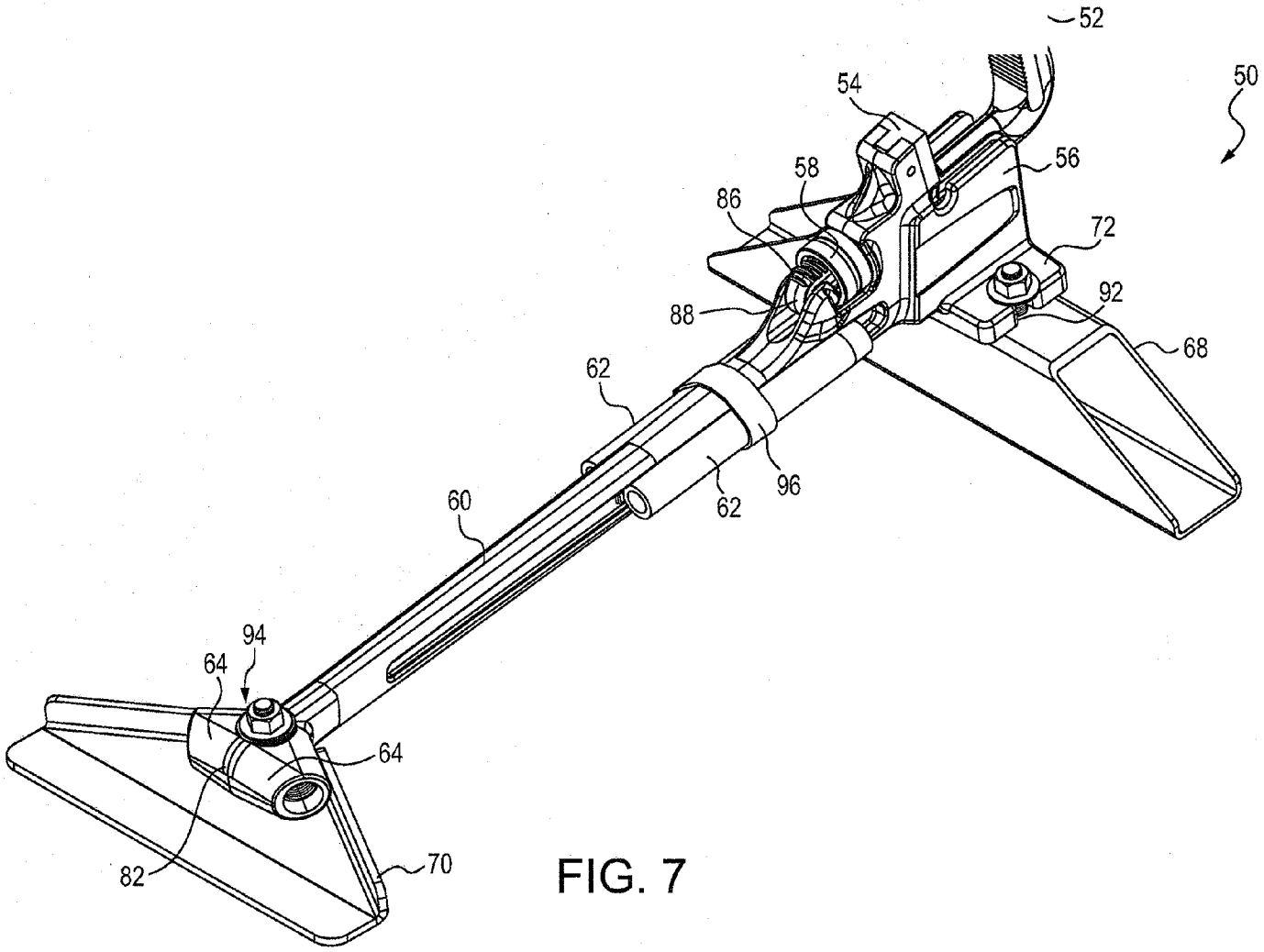
FIG. 7 illustrates another perspective view of the integrated foot vise and wrench of FIG. 6.
Figure 8:
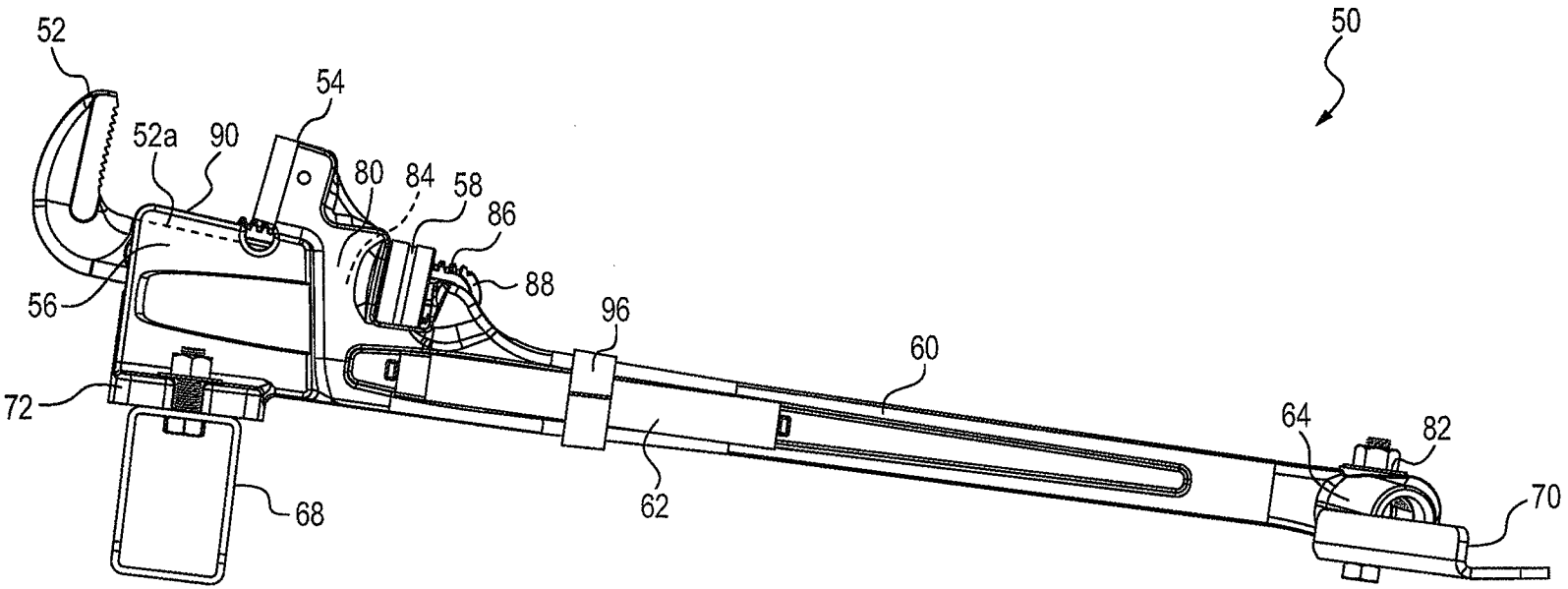
FIG. 8 illustrates a side elevational view of the integrated foot vise and wrench of FIG. 6.
Figure 9:
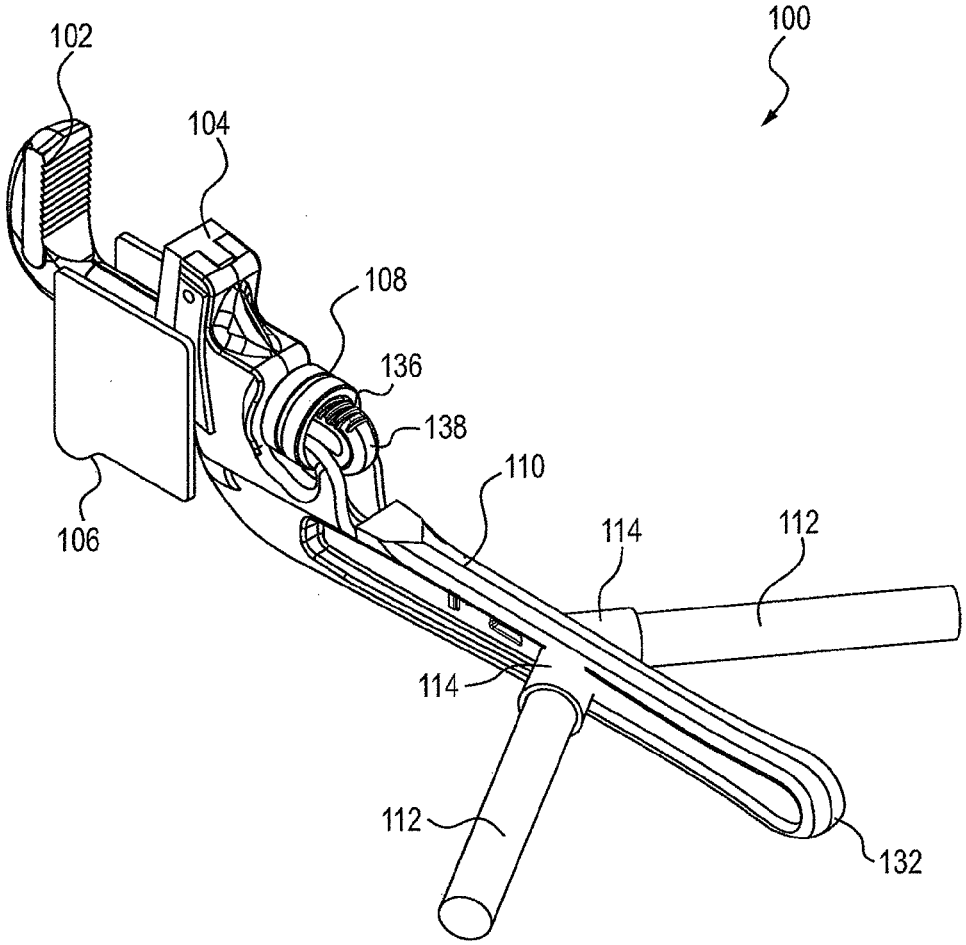
FIG. 9 illustrates a perspective view of an integrated foot vise and wrench, in accordance with another embodiment of the present disclosure.

FIGS. 6-8 illustrate another embodiment of an integrated foot vise and wrench 50 in accordance with the present subject matter. The tool 50 is similar to the previously described tool 1. The tool 50 comprises a movable jaw 52, a fixed jaw 54, workpiece supports 56 having support edges 90, an adjustable nut 58 for selectively positioning the movable jaw 52, and a handle 60 defining a distal end 82. The tool 50 also comprises a sleeve 80 having a receiving region 84, and a shank 88 with a threaded region 86. The frontwardly directed edges 90 of the support plates are forwardly spaced from a forwardly directed face 52*a* of the movable jaw 52 or shank portion thereof. The tool 50 also includes removable support legs 62 which can be attached to adapters 64. The tool 50 additionally includes outwardly extending mounting ears 72 having openings 92. And, the tool 50 includes a mounting opening 94 at the handle end 82.

The version of the tool 50 in FIGS. 6-8 is shown as having the support members 62 detached from their corresponding adapters 64. Each support member 62 is conveniently retained along the handle 60 and specifically along a side region of the handle by a retaining band 96. The retaining band or strap 96 can be formed from an elastic or flexible material. Other materials and releasable affixment provisions are contemplated such as nylon straps with snaps or velcro regions for attaching the strap ends to each other and/or one or both strap ends to the tool.

In the version of the tool 50 depicted in FIGS. 6-8, the tool 50 is shown in use with two support bases 68, 70. Specifically, a first support base 68 is disposed at or near the working end of the tool 50 and is engaged to a rearwardly directed face of the mounting ears 72. The first support base 68 can be engaged to the tool 50 by threaded fasteners extending through openings 92 in the mounting ears 72. A second support base 70 is disposed at or near the distal end 82 of the tool 50 and is engaged to a rearwardly directed face or region of the adapters 64 or the end 82 of the handle 60. The second support base 70 can be engaged to the tool 50 by a threaded fastener extending through the opening 94.

Although not wishing to be limited to any particular application or use, it is contemplated that the tool 1 shown in FIGS. 1-5 will find use in work settings in which space constraints may exist so that a workstand or tristand pipe vise is not available and/or a work bench or vehicle bumper is unavailable for mounting a vise. The tool 1 is particularly well suited for assembling, disassembling, cutting and/or threading pipes having diameters up to about 1 inch. In certain versions, the tool 1 can be used with pipes having diameters as large as 2½ inches or greater. In a particular version of the tool 1, the support members 12 are in the form of one-half inch diameter pipe sections having threaded end regions. The corresponding adapters 14 include threaded female receiving regions. It is also contemplated that the pipe sections could be provided with and in certain instances sold with the tool 1.

It is contemplated that the tool 50 shown in FIGS. 6-8 will find wide use in oil and gas field work which typically involves forming, repairing, or maintaining collection pipelines across regions of land. The tool 50 can be used to assemble and/or disassemble, i.e., disengage, various pipe connections and fittings. The tool 50 would typically be used in conjunction with one or more plates or bases that can be bolted to the tool, such as support bases 68, 70. The plates or bases serve to increase the footprint and extent of contact between the tool and the ground or support surface. The plates or bases also reduce the potential of the tool 50 sinking into soft ground, and to promote overall stability. A variety of plates and bases could be used as the support bases 68, 70. In one version, it is contemplated that a rectangular hollow member having a cross sectional size of about 2 inches by 4 inches could be provided with the tool. A user could then select whether to orient a base with a 2 inch riser or a 4 inch riser at each end of the tool. The support bases could be provided or sold with the tool, or provided or sold separately from the tool.

Although the tool 50 is depicted in the referenced figures as attached to the support bases 68, 70 by multiple threaded fasteners, it will be appreciated that the present subject matter includes a wide array of affixment assemblies and techniques. For example, attachment bands, clamps, mechanical assembles, and other structures are contemplated.

Referring to FIGS. 9 to 12, an integrated foot vise and wrench 100 is disclosed, in accordance with another embodiment of the present subject matter. As previously described, the integrated foot vise and wrench 100 is similar to the previously described tools 1 and 50 and is adapted to be used as a wrench and as a foot or ground vise. The integrated foot vise and wrench 100 can be used on various workpieces such as pipes, conduits, cylindrical objects, roundstock, and the like. It will be appreciated that the vise and wrench 100 can also be used in association with other workpieces having noncylindrical shapes. In the event that the tool is to be used for noncylindrical workpieces, it is contemplated that jaws having different shapes and/or configurations can be used. The integrated foot vise and wrench 100 includes a hook jaw 102, a heel jaw 104, a workpiece support 106, an adjusting nut 108, a handle 110, a pair of support members 112 and a pair of adapters 114. The hook jaw 102 is typically movable or linearly displaceable as described herein and is as a movable jaw. The movable jaw includes an elongated shank portion 138 having a threaded region 136. The heel jaw or fixed jaw 104 is typically affixed to or integrally formed at an end of the handle 110. The adjusting nut 108 is typically rotatably and threadedly engaged with the threaded region 136 of the shank portion 138 of the movable hook jaw 102. The handle 110 defines a working end at which are generally located the fixed jaw 104 and a sleeve or other member which receives the movable jaw 102, as previously described.

The workpiece support 106 is adapted to support a workpiece such as a pipe thereon. The workpiece support 106 precludes displacement of the hook jaw 102 due to contact otherwise occurring between the workpiece and shank of the hook jaw 102. Specifically, as previously explained herein the workpiece supports 106 extend forwardly of the front face of the shank portion of the movable jaw by a distance E.

Figure 10:
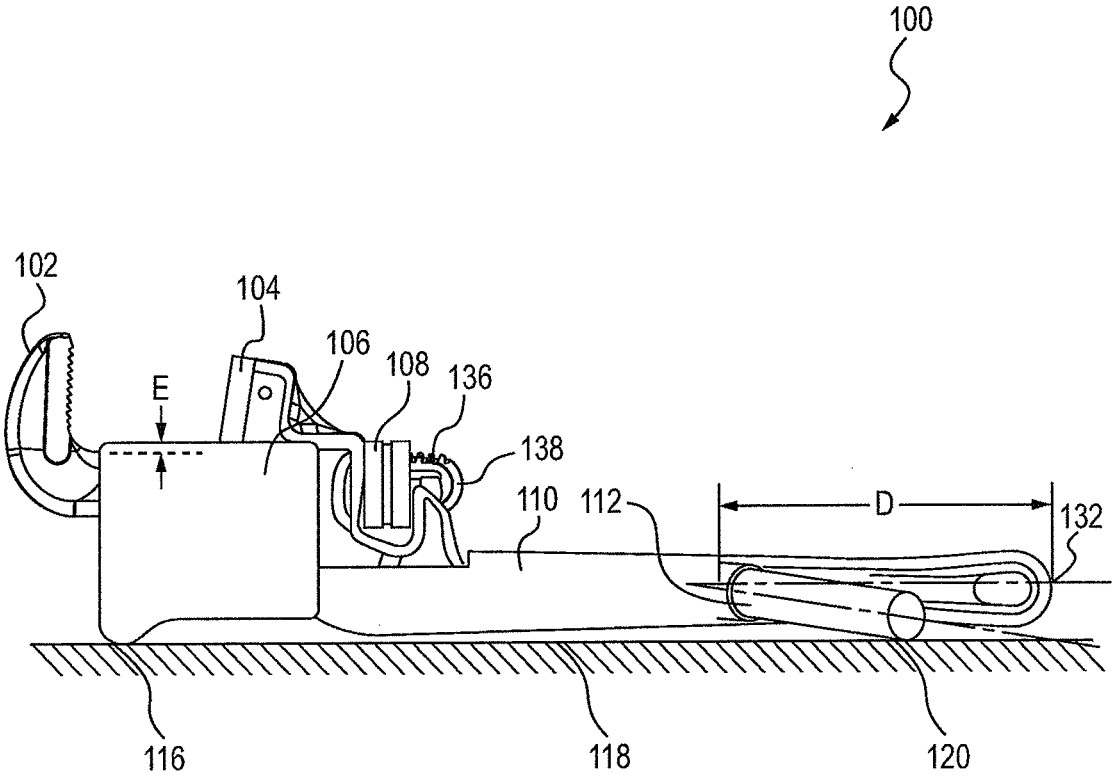
FIG. 10 illustrates a side elevational view of the integrated foot vise and wrench of FIG. 9 depicting use thereof as a foot vise.

Referring to FIG. 10, use of the integrated foot vise and wrench 100 as a foot vise is generally as follows. When using the device 100 as a foot vise, a user engages the support member(s) 112 to the adapter(s) 114 provided on the handle 110. When positioned on the ground 118 or other support surface, the device 100 rests on the two support members 112 and a point of contact 116 provided at the rear of the workpiece support 106. The points of contact between the support members 112 and the ground 118 is depicted by reference numeral 120. In this particular arrangement, three points of contact occur between the ground and the device. The user then places a pipe or workpiece on the workpiece support 106 and positions the movable hook jaw 102, by rotating the adjusting nut 108, so that the pipe becomes clamped or otherwise retained between the hook jaw 102 and the fixed heel jaw 104. The integrated foot vise and wrench 100 of the present subject matter can also be used as a vise while supported on an elevated work surface such as a bench for example. Furthermore, it will be understood that nearly any of the various embodiments and tools of the present subject matter can also be used as a vise while supported on an elevated work surface such as a bench for example.

Figure 11:
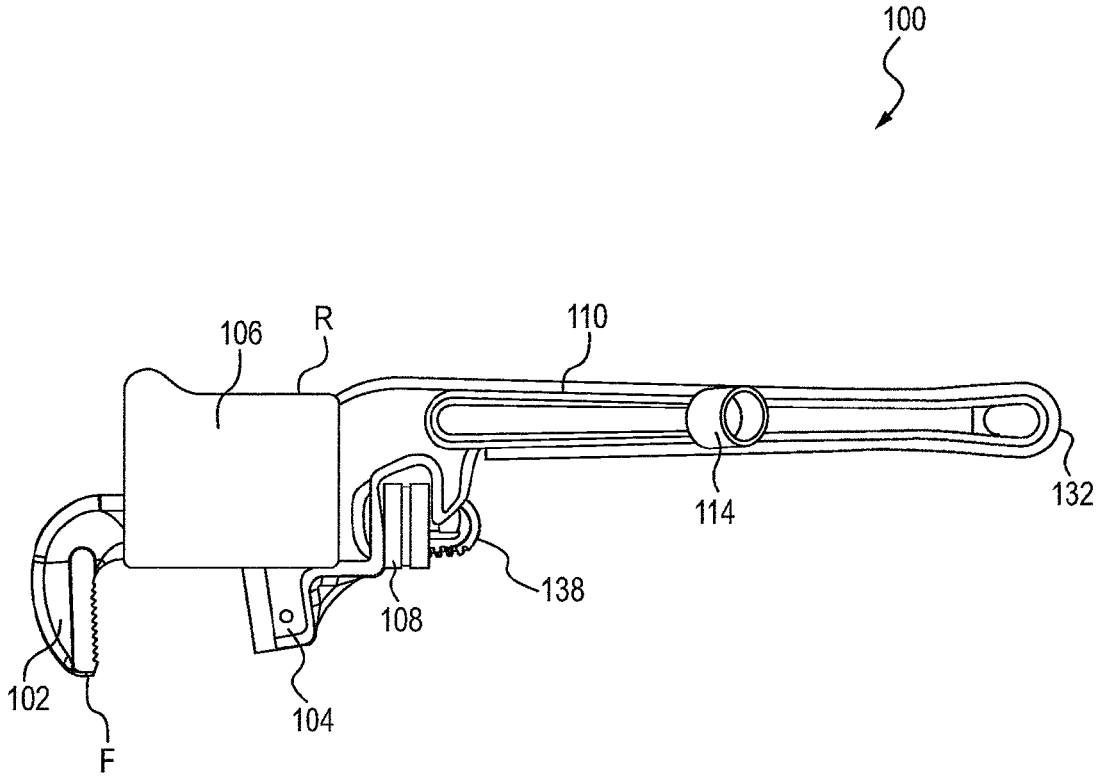
FIG. 11 illustrates another side elevational view of the integrated foot vise and wrench of FIG. 9 depicting use thereof as a wrench.

Referring to FIG. 11, use of the integrated foot vise and wrench 100 as a wrench is disclosed. When a user utilizes the tool 100 as a wrench the user disengages the support members 112 from their engagement with the adapters 114 and the handle 110 and uses the tool as a typical wrench. The integrated adapters 114 for the support members 112 are located at a relatively far distance from the working end of the handle 110 so that the user has a sufficient amount of handling length when using the device as a wrench. In one embodiment, the integrated adapters 114 for the support members 112 are located at a distance of D (illustrated in FIG. 10) from a distal end 132 of the handle 110 so that the user has a sufficient amount of handling length when using the device 100 as a wrench. In one embodiment, the distance of D from the distal end 132 of the handle is approximately 6 inches. However, the present subject matter is not limited to any particular distance for the integrated adapters 114 as measured from the distal end 132 of the handle 100.

Figure 12:
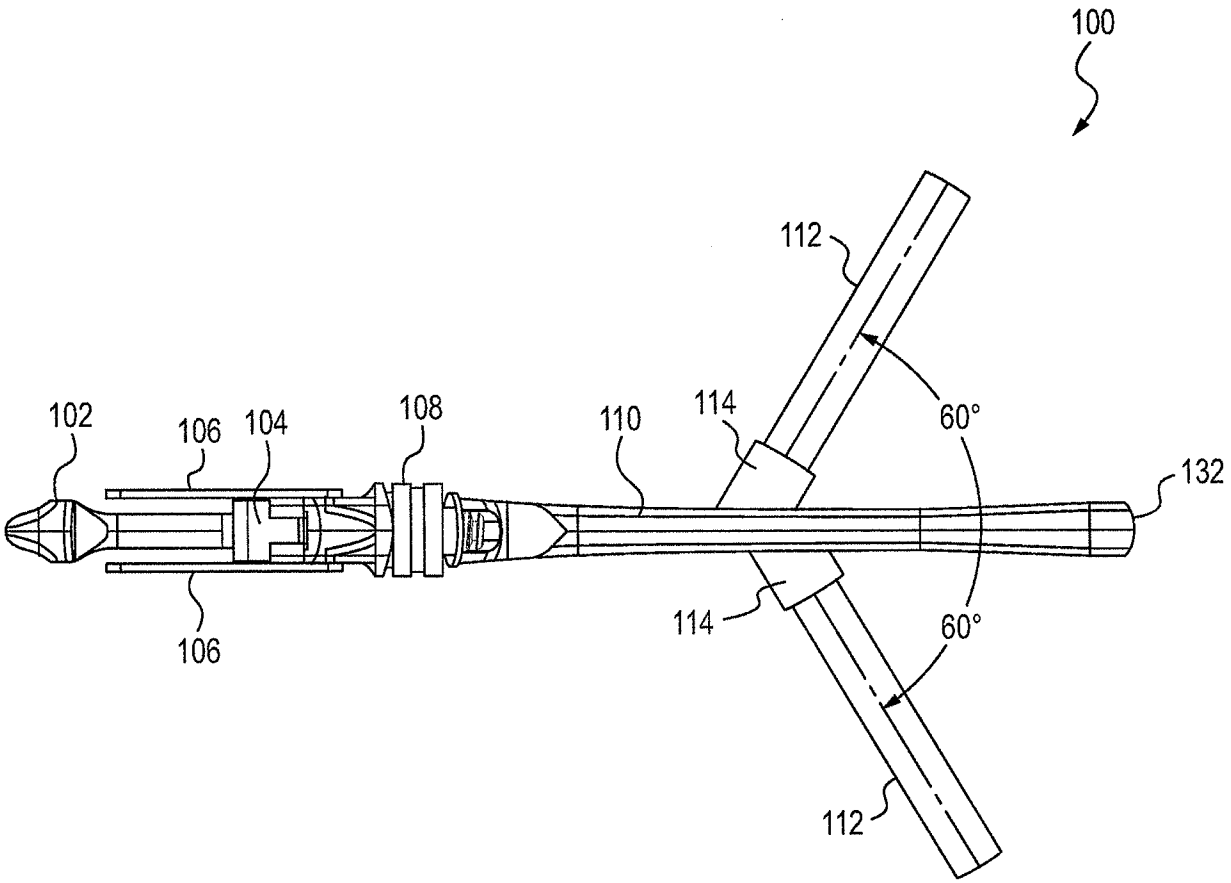
FIG. 12 illustrates a front view of the integrated foot vise and wrench of FIG. 9.

Referring to FIG. 12, in one embodiment, the integrated adapters 114 are oriented at an angle of approximately 60° from a plane bisecting the tool 100 and extending between front F and rear R regions of the tool (see FIGS. 11 and 12). Such adapter orientation promotes stability of the integrated foot vise and wrench 100, when used as a foot vise. In FIG. 12, a particular arrangement of adapters 114 relative to the handle 110 is shown. In that illustrated version, the adapters 114 are offset from one another and thus are not symmetrically located. This arrangement may promote ease in manufacturing or improved distribution of forces or loading on the device. However, the present subject matter includes symmetrical arrangements of adapters on the tools and devices.

In one embodiment, the workpiece support 106 extends and is spaced toward the front F of the tool 100, e.g., spaced from the shank 138 of the hook jaw 102 by distance E (illustrated in FIG. 10) so that a workpiece or pipe contacts the workpiece support 106 instead of the shank portion 138 of the movable hook jaw 102 when the workpiece is positioned between the jaws and/or in the workpiece engaging region.

As previously noted, the tool systems such as those depicted in FIGS. 1-12 can include provisions so that the one or more lateral support members can be selectively stowed alongside the handle. This configuration is useful when the tool is used as a wrench. In addition, the tool systems can include provisions so that the one or more lateral support members can be engaged to the handle so that the member(s) extend outward therefrom. This configuration is useful when the tool is used as a vise.

Figure 13:
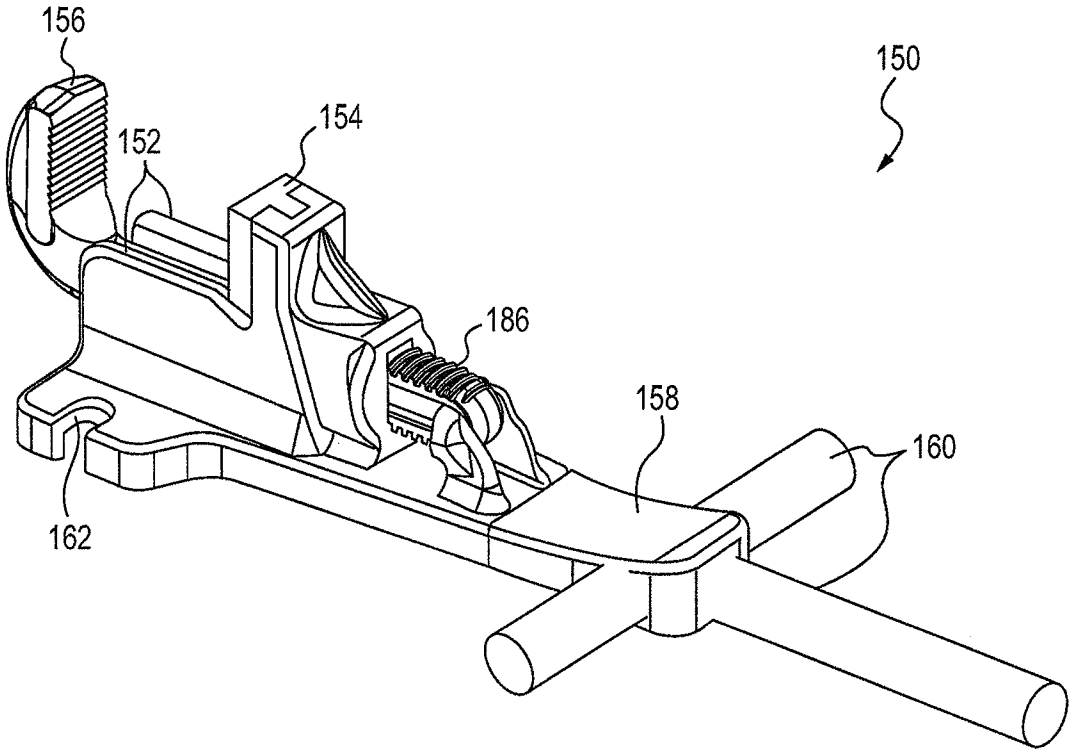
FIG. 13 illustrates a perspective view of an integrated foot vise and wrench, in accordance with another embodiment of the present disclosure.

Referring to FIG. 13, an integrated foot vise and wrench 150 is disclosed, in accordance with another embodiment of the present disclosure. The integrated foot vise and wrench 150 includes an extended workpiece supporting member 152, a fixed heel jaw 154, a movable hook jaw 156 having a shank and a threaded region 186, a body 158 and outwardly extending support members 160. The extended workpiece supporting member 152 is adapted to facilitate resting of a workpiece or pipe thereon. The hook jaw 156 is adapted to slide freely to accommodate workpieces of various sizes and facilitate gripping of the workpieces between the movable hook jaw 156 and the fixed heel jaw 154. In this embodiment, the body 158 has a pair of laterally projecting ears 162 at the hook jaw end so that the integrated foot vise and wrench 150 can be bolted or otherwise engaged to a support surface while using the tool as a vise. The tool 150 includes a variety of other features and aspects as previously described herein with other tools.

Figure 14:
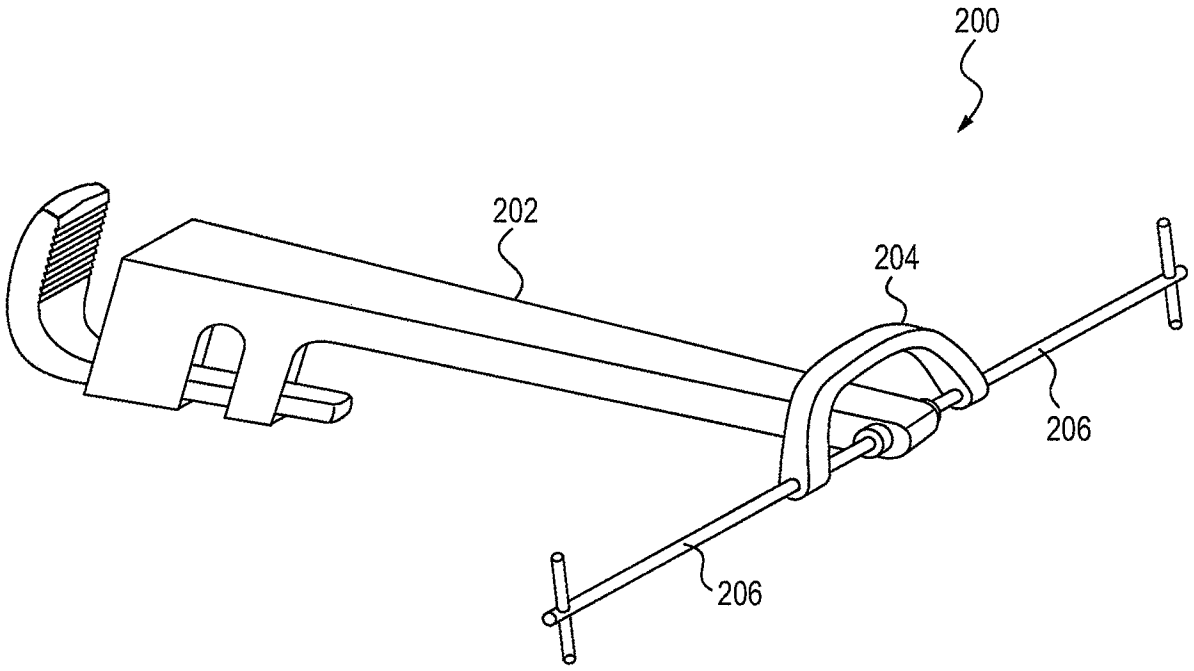
FIG. 14 illustrates a schematic perspective view of an integrated foot vise and wrench, in accordance with yet another embodiment of the present disclosure.

Referring to FIG. 14, an assembly of foot vise and wrench 200 is schematically disclosed, in accordance with yet another embodiment of the present disclosure. The foot vise and wrench assembly 200 includes a pipe wrench 202 and C-frame assembly 204. The C-frame assembly 204 includes two outwardly extending threaded members 206. The foot vise and wrench assembly 200 can be used as both a vise and a wrench. The foot vise and wrench assembly 200 does not require alterations in the wrench. The foot vise and wrench assembly 200 is cost effective. The C-frame 204 is affixed at a distal end of the handle of the pipe wrench 202. In the version depicted in FIG. 14, the C-frame assembly 204 is releasably engaged with and separable from the wrench 202. However, the present subject matter includes embodiments in which the C-frame assembly is partially formed with or otherwise affixed to the wrench 202.

Figure 15:
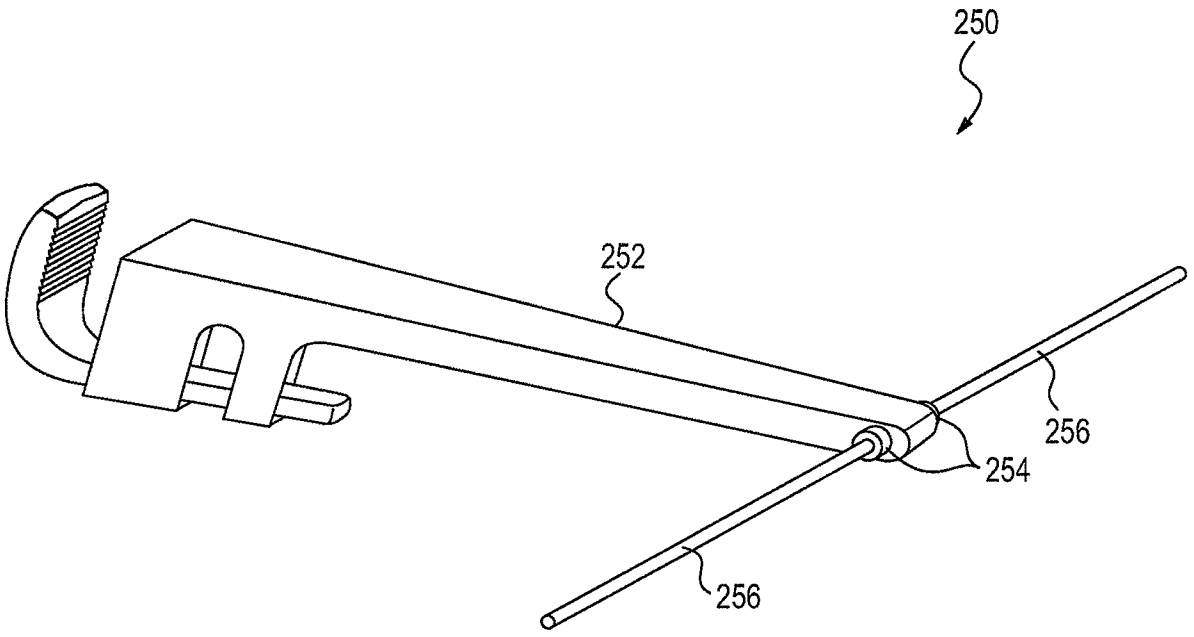
FIG. 15 illustrates a schematic perspective view of an integrated foot vise and wrench, in accordance with yet another embodiment of the present disclosure.

Referring to FIG. 15, another assembly of a foot vise and wrench 250 is schematically disclosed, in accordance with yet another embodiment of the present disclosure. The foot vise and wrench assembly 250 includes a pipe wrench 252 with two nuts or other mounting receptacles welded or casted at the tail end portion of the wrench. Outwardly extending threaded members 235 can be engaged therewith. The foot vise and wrench assembly 250 is cost effective. Also, the foot vise and wrench assembly 250 can be used as a vise and a wrench.

Figure 16:
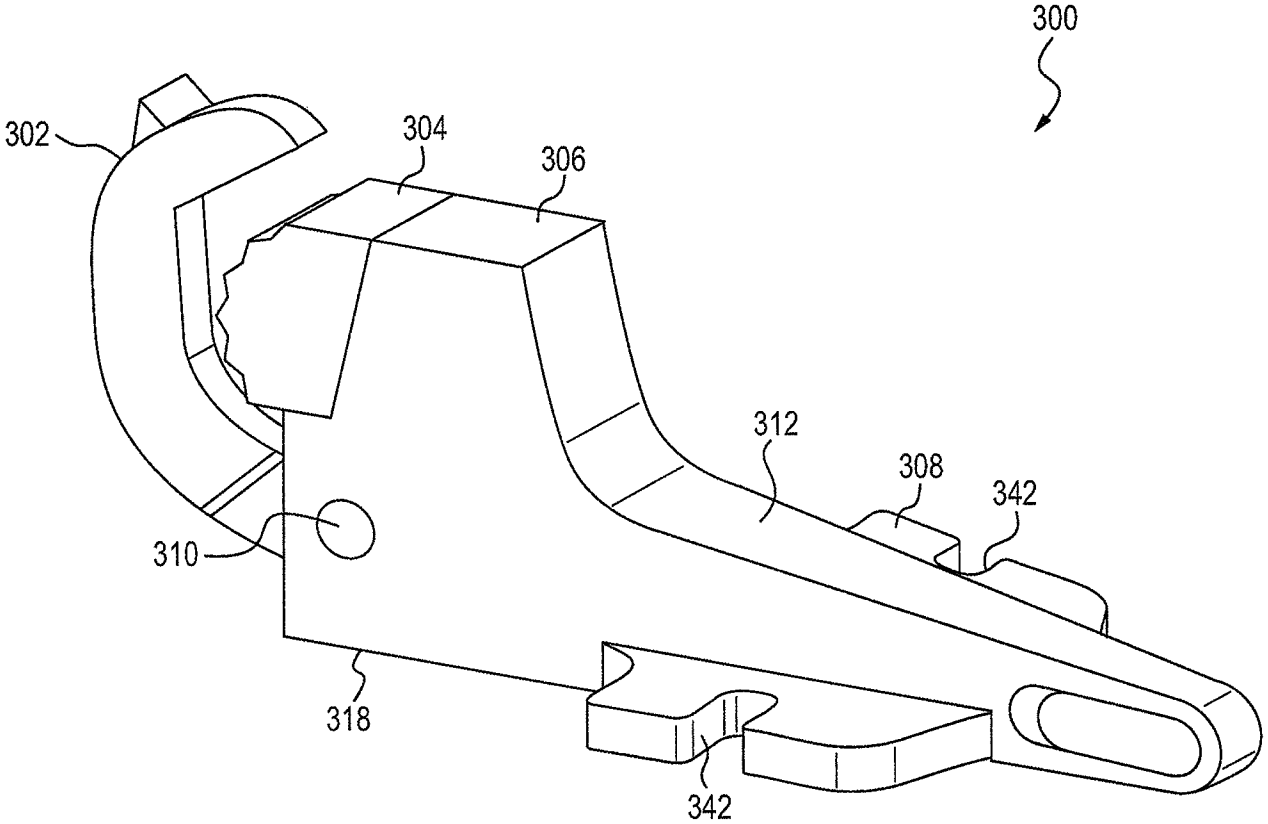
FIG. 16 illustrates a schematic perspective view of an integrated foot vise and wrench, in accordance with yet another embodiment of the present disclosure.

Referring to FIG. 16, an integrated foot vise and wrench 300 is schematically disclosed, in accordance with yet another embodiment of the present disclosure. The integrated foot vise and wrench 300 includes a movable jaw 302, a fixed heel jaw 304, a body 306, a support structure 308 and a pivot member 310. In certain tool versions, the height of the pivot point 310 or distance from a rear face 318 of the tool 300 is configured in such a manner that the movable jaw 302 can swivel freely about the member 310 without contacting the ground or other support surface. Generally, the tool 300 includes mounting apertures or slots 342 defined in the support structure 308. The support structure 308 includes two members that extend laterally outward from a handle 312 of the tool 300. The integrated foot vise and wrench 300 is light in weight and quick acting. Also, the integrated foot vise and wrench 300 is adapted to be conveniently used as a wrench.

Figure 17A:
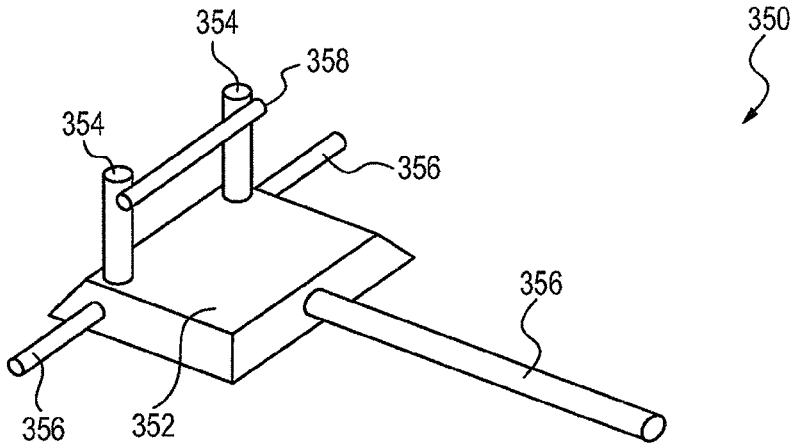
FIGS. 17A and 17B illustrate schematic perspective views of stands for use with a wrench, in accordance with yet another embodiment of the present disclosure.
Figure 17B:
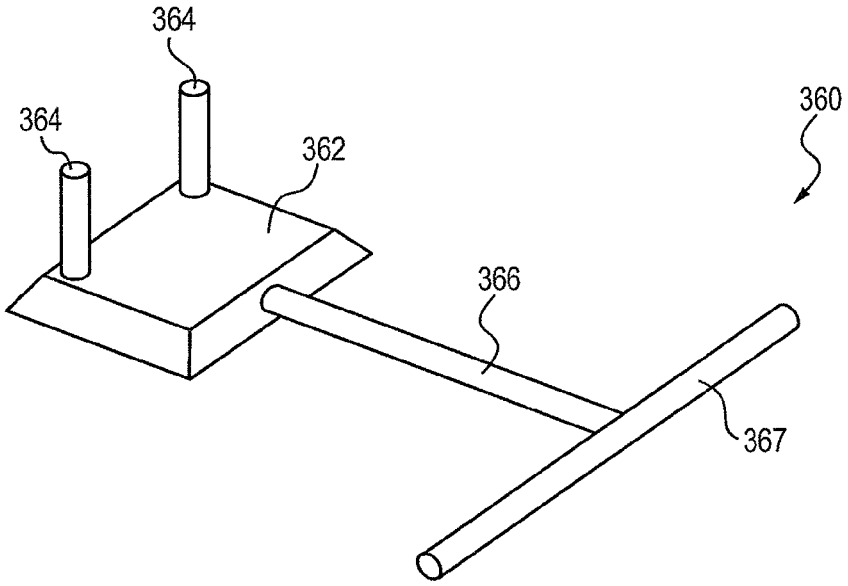

In certain embodiments, the present subject matter also includes assemblies that can be used with a conventional pipe wrench to promote stability during use, and which can be readily separated form the wrench. Referring to FIGS. 17A and 17B, stands 350 and 360 for use with a conventional wrench (not shown) are schematically disclosed, in accordance with yet another embodiment of the present disclosure. The separable stand 350 includes a base 352, one or more upwardly extending members or arms 354, one or more laterally extending support members 356, and a pin or other retaining member 358 which can be selectively positioned and releasably engaged with one or more of the arms 354. The pin 358 can be utilized with other components or mechanisms to secure a wrench to the base 352. The collection of outwardly extending support members 356 serve to promote stability of the base 352 and particularly when a wrench is positioned within the arms 354.

FIG. 17B illustrates a stand 360 that includes a base 362, one or more upwardly extending members or arms 364, and laterally extending support members 366, 367. The stand 360 may optionally include one or more pins (not shown) to secure a wrench when positioned on the base 362 and between the arms 364. The support members 366 and 367 are transversely oriented with respect to one another. It will be appreciated that the present subject matter includes a wide variety of stands and components for use with pipe wrenches.

Figure 18A:
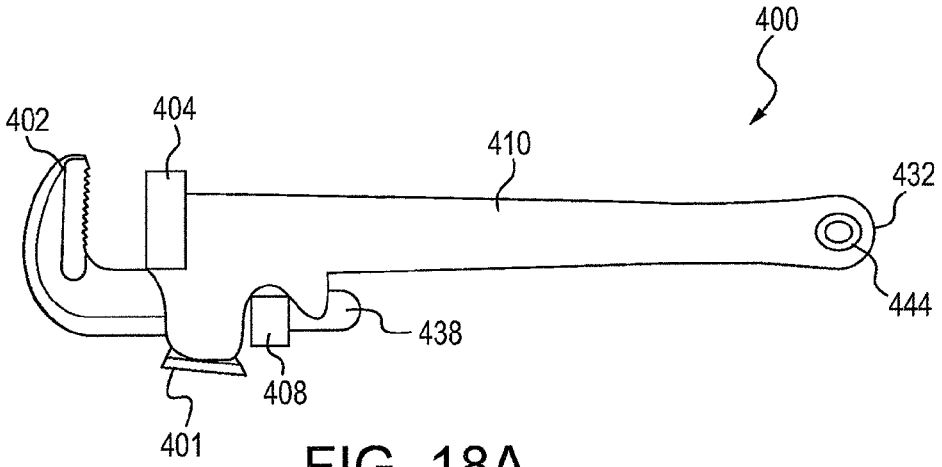
FIGS. 18A and 18B illustrate schematic views of an integrated foot vise and wrench, in accordance with yet another embodiment of the present disclosure.
Figure 18B:
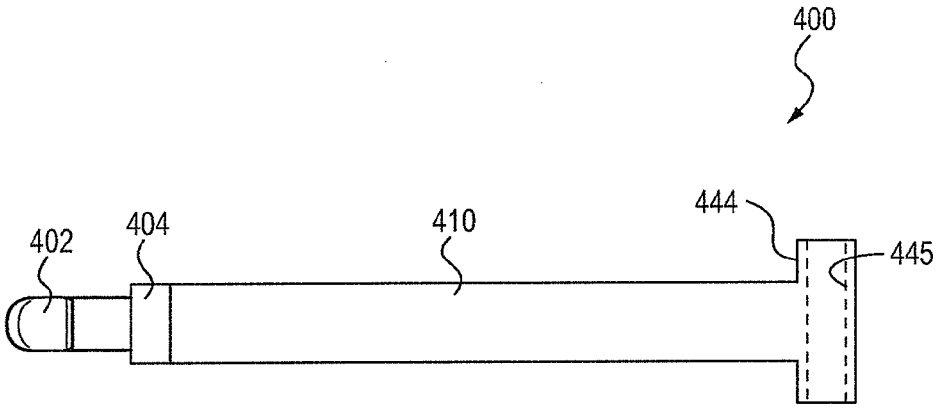

Referring to FIGS. 18A and 18B, an integrated foot vise and wrench 400 is schematically disclosed, in accordance with yet another embodiment of the present disclosure. The wrench 400 is similar to other integrated tools described herein and comprises a movable jaw 402 having a shank portion 438, a fixed jaw 404, a nut or rotatable member 408 in threaded engagement with the shank 438, and a handle 410. The wrench 400 includes an adapter 444 at a distal end 432 of the handle 410. In the particular version shown in FIGS. 18A and 18B, the adapter 444 defines a receiving region 445 extending through the adapter 444 and transversely oriented with respect to a longitudinal axis of the handle 410. The receiving region 445 may be sized to accept a ½ inch, ¾ inch, or other size pipe. The integrated foot vise and wrench 400 includes a flat surface 401 provided along a rear region of the tool 400 to facilitate or promote support for the integrated foot vise and wrench 400. In certain versions, the flat support is appropriately angled with respect to the longitudinal axis of the handle to facilitate support on the ground or other support surface.

Figure 19A:
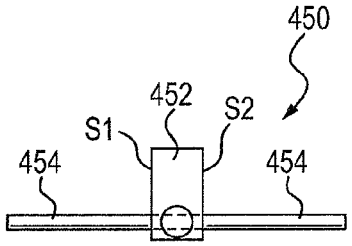
FIGS. 19A to 19D illustrate schematic views of an integrated foot vise and wrench, in accordance with yet another embodiment of the present disclosure.
Figure 19C:
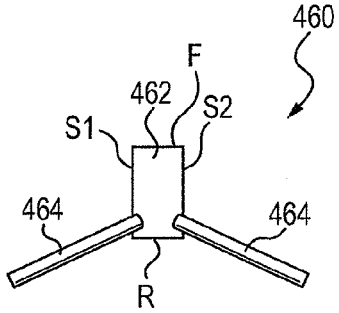
Figure 19B:
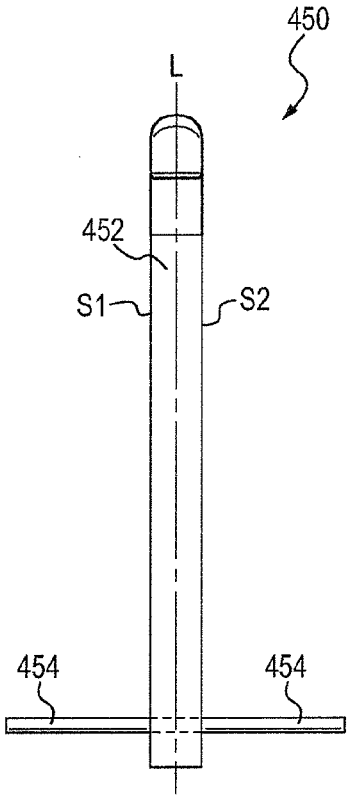

Referring to FIGS. 19A to 19D, integrated foot vise and wrenches 450, 460 are schematically disclosed, in accordance with yet another embodiment of the present disclosure. The integrated foot vise and wrenches 450, 460 include angled bosses for providing contact for stability. Specifically, FIGS. 19A and 19B schematically illustrate a wrench 452 as described herein having a pair of transversely and laterally extending support members 454 or bosses disposed at or proximate a distal end of the handle of the wrench 452. When viewed from an end of the wrench 452 as in FIG. 19A, each member 454 extends laterally and transversely outward from a respective side S1, S2 of the wrench 452. When viewed from a front or rear of the wrench as in FIG. 19B, each member extends laterally outward and transversely from a respective side S1, S2 such that the members 454 are oriented at right angles to the longitudinal axis L.

Figure 19D:
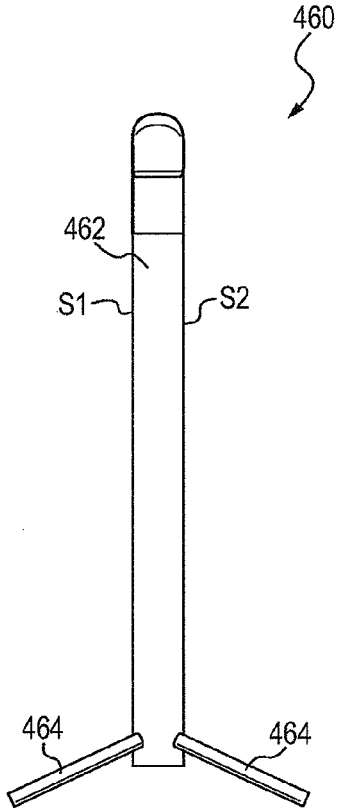

FIGS. 19C and 19D schematically illustrate a wrench 462 as described herein having a pair of angled and laterally extending support members 464 or bosses disposed at or proximate a distal end of the handle of the wrench 462. When viewed from an end of the wrench 462 as in FIG. 19C, each member 464 extends laterally outward and toward a rear R from a respective side S1, S2 of the wrench 462. When viewed from a front or rear of the wrench as in FIG. 19D, each member 464 extends laterally outward from a respective side S1, S2 and toward or beyond a distal end of the handle of the wrench 462. The integrated foot vise and wrench 460 provides increased length for torque reaction.

Figure 20A:
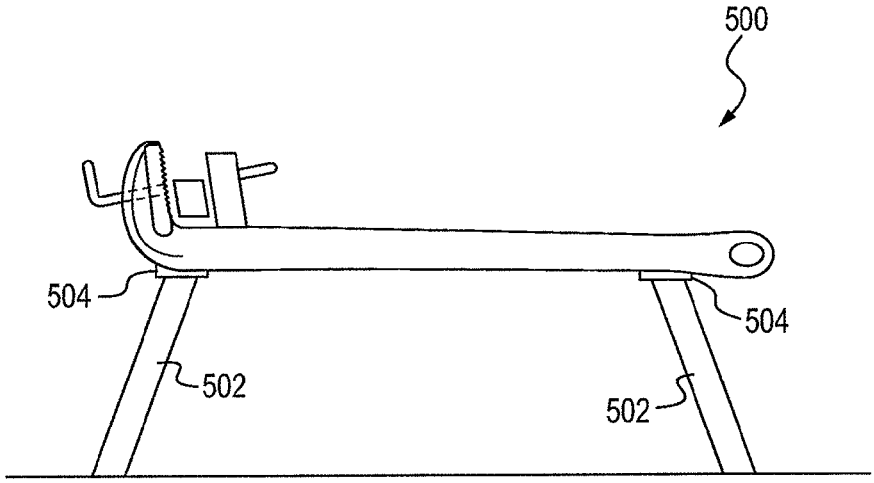
FIGS. 20A to 20D illustrate schematic views of an integrated foot vise and wrench, in accordance with yet another embodiment of the present disclosure.
Figure 20B:
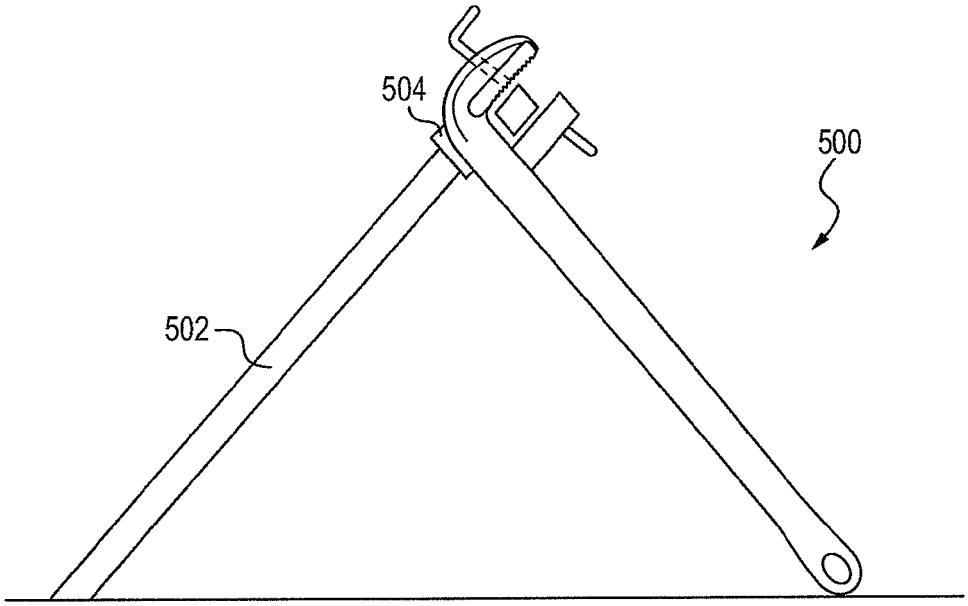
Figure 20C:
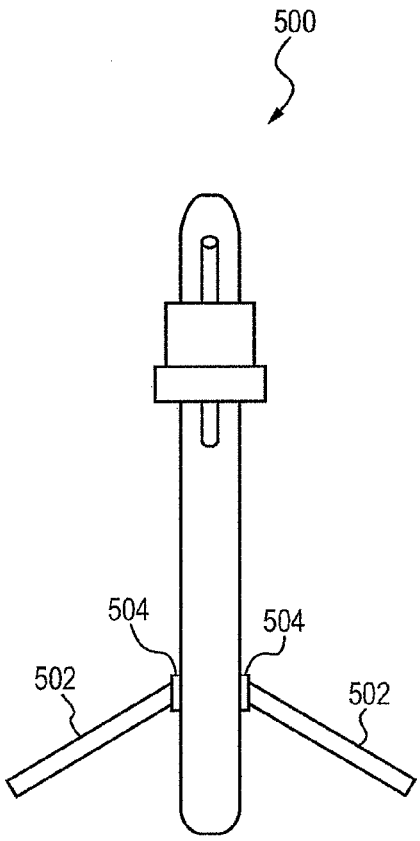
Figure 20D:
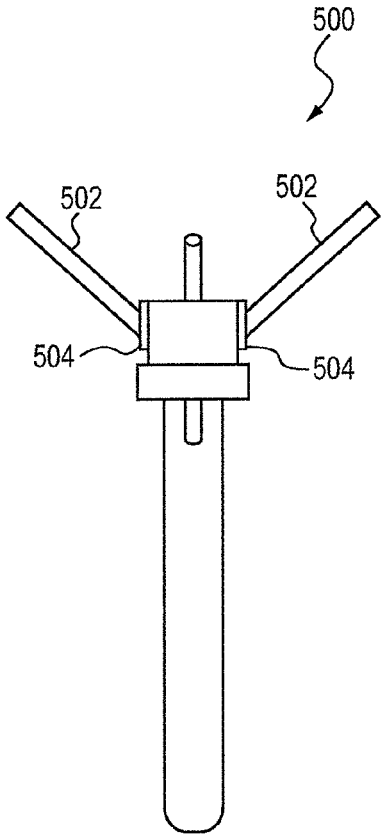

Referring to FIGS. 20A to 20D, an integrated foot vise and wrench 500 is schematically disclosed, in accordance with yet another embodiment of the present disclosure. The integrated foot vise and wrench 500 includes a plurality of support members in the form of releasably engageable pipes 502. The plurality of pipes include threaded sections. The threaded sections of the pipes are engaged with corresponding threaded receiving adapters 504 and used to elevate the wrench 500 off the ground or other support surface to achieve a comfortable work height. Pipes 502 having various length can be used to position the elevated wrench at nearly any workable height, inclination, and/or position. Moreover, by selective choice of adapter 504 and pipe 502, other particular positions of the wrench can be achieved such as shown in FIG. 20B. Furthermore, pipes 502 or other support members can be provided at a working end of the wrench and extend outwardly therefrom and in a direction opposite the distal end of the handle such as depicted in FIG. 20D.

Figure 21A:
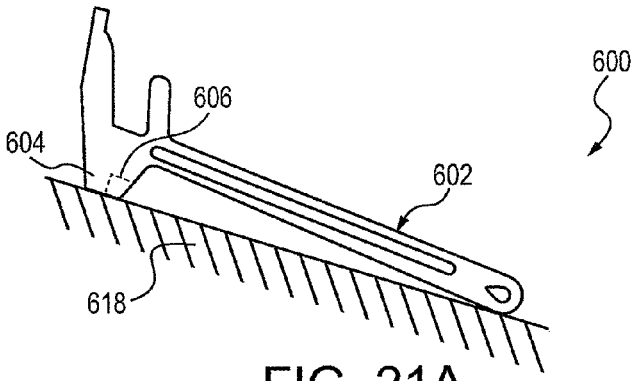
FIGS. 21A to 21E illustrate schematic views of an integrated foot vise and wrench, in accordance with yet another embodiment of the present disclosure.
Figure 21B:
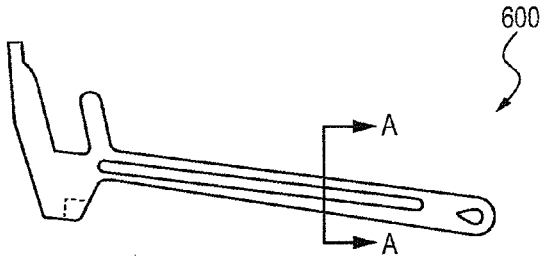
Figure 21C:
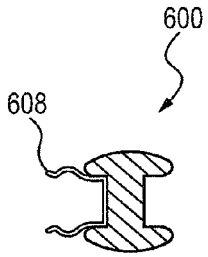
Figure 21D:
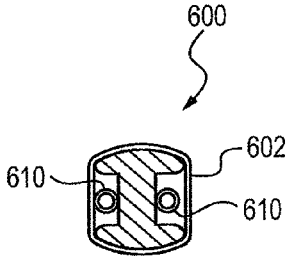
Figure 21E:
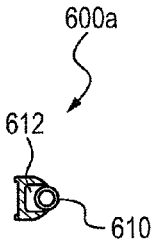

Referring to FIGS. 21A to 21E, an integrated foot vise and wrench 600 is schematically disclosed, in accordance with yet another embodiment of the present disclosure. The integrated foot vise and wrench 600 may include a flexible band 602, an additional material portion 604, a threaded portion or plain bore 606 and one or more spring clip(s) 608. The band 602 is adapted to secure a rod, smaller pipe or unthreaded reaction bar or support member 610. The threaded portion or plain bore 606 is sized to receive and engage a pipe or the reaction bar 610. Specifically, one or more bands 602 can be used to retain a reaction bar alongside the wrench handle. The bore 606 can be provided to receive an end of a support member, a pipe, or the reaction bar 610. The additional material portion 604 can serve to reinforce one or more structural components of the wrench, provide mounting or support provisions for the wrench, or provide elevation or spacing between a working end of the wrench and the ground or support surface 618. The spring clip(s) 608 are configured to releasably attach one or more pipes, reaction bars 610, or other members alongside the wrench. The spring clip(s) can be permanently attached to or formed with the wrench, or can be frictionally engaged with the wrench such as shown in FIG. 21C. FIGS. 21C and 21D illustrate a cross section taken along a section line A-A in FIG. 21B. FIG. 21D illustrates the band 602 used to hold reaction bars 610 against a handle for transport. FIG. 21E depicts a different cross-sectional configuration for a variant version 600*a* in which a recessed receiving region 612 is defined along a region of the handle sized to frictionally engage and retain a bar 610.

As previously described in conjunction with the tools 1, 50, and 100 for example which are shown in FIGS. 1-12, in certain versions of the present subject matter the tools comprise support plates along opposite sides of the tool which extend forwardly of a frontward facing surface of the shank portion of the movable jaw. As previously explained, the support plates define frontwardly directed edges upon which a workpiece can contact during placement of the workpiece in the workpiece engaging region defined between the jaws of the tool. Support of the workpiece by the plates allows pivoting and "ratcheting" action of the movable jaw during engagement of the tool and workpiece. Although the movable jaw may be pivotally movable with respect to the handle and/or sleeve as previously explained, in many of the embodiments the extent of movement of the movable jaw is insufficient to cause the frontward facing surface of the shank portion of the movable jaw to extend forwardly of the edges of the support plates. Thus, referring to FIG. 3 for example, during pivotal movement of the jaw 2 relative to the handle 10 and/or sleeve 30, the surface 2*a* does not extend beyond the edge 40 of the plates 6. However, the present subject matter also includes embodiments in which the frontward facing surface of the shank portion of the movable jaw can be exposed or positioned forwardly of the noted edges of the plates such as during portions of travel or pivoting of the movable jaw.

In many embodiments, the integrated foot vise and wrench is adapted for use with workpieces such as pipes having a diameter in the range of about 0.5 inch to about 6 inches. Various referenced figures illustrate a unit having a capacity up to about 2½ inches. However, the present subject matter includes tools accommodating workpieces smaller and/or larger than these sizes.

The integrated foot vise and wrench, in accordance with the present disclosure described herein provides numerous benefits and advantages including but not limited to the following.

The body or casting, and typically the handle of the tool, is configured in such a manner that the integrated foot vise and wrench can be used as a wrench or a foot vise. Use as either a wrench or vise does not require any accessory component. The user removes the support members from the body or handle to place the apparatus in a wrench configuration.

In certain embodiments, the integrated foot vise and wrench also includes an extended support from the workpiece support adjoining the movable hook jaw. The integrated workpiece support extends from the body adjoining the hook jaw at a distance above the shank of the hook jaw. This provides several benefits as follows. This provision maintains a gap between the hook jaw and workpiece. This is especially useful when the tool is used as a vise because of the orientation of the pipe to the hook jaw. This provision allows favorable orientation for ratcheting and gripping. This provision provides lower stresses applied to the hook jaw as compared to if a pipe contacted the shank of the hook jaw when loaded. This provision facilitates ease of use for an end user when locating the pipe in the vise. Thus, there is no need to check the gap between the hook jaw and pipe. During gripping conditions, the pipe is urged against an integrated workpiece support. This increases gripping force since the pipe remains in contact with the fixed heel jaw and the movable hook jaw only. Furthermore, pipe stability is improved when the wrench is used as a vise by providing a stationary rest for longer pipes and providing a rest on both sides of the movable hook jaw when used on short pieces of pipe/fittings. Adjustment is made easier because the weight of the pipe is not loaded or placed upon the hook jaw or the rotatable nut. And, the slight inclination of the integrated workpiece support is towards the fixed heel jaw, which in turn helps ease of adjustment.

The integrated foot vise and wrench exhibits improved stability on irregular or uneven ground surfaces. A three point contact provided by the workpiece support and the support members in certain versions, promotes stability of the integrated foot vise and wrench when used as a foot vise. The tools of the present subject matter are stable on uneven ground surfaces due to three points of contact between the ground and the tool. In many versions of the tools and particularly those utilizing the noted three point contact configuration, in the event that the working or head end of the tool raises up or is lifted up from the ground (such as when applying excessive torque to a workpiece engaged in the jaws of the tool), the remaining two points of contact at the handle end maintain lateral stability of the tool.

In certain embodiments, the adjusting nut of the present subject matter vise/wrench is positioned such that when the integrated foot vise and wrench is used as a foot vise, the nut is located on the front or upper side of the body or handle. This facilitates an ease of use for the user as the adjusting nut is readily accessible.

The integrated foot vise and wrench is cost effective as it performs the functions of both a vise and a wrench and has a structural configuration that facilitates manufacturing.

No additional supporting accessory is required. Little or no modifications in the structure of the device are required. Accordingly, the integrated foot vise and wrench is easy to operate.

In certain embodiments, the frontwardly directed edges of the support plates, e.g., edges 40 of the support plates 6 in FIG. 3 and edges 90 of the support plates 56 in FIG. 8 for example, may be oriented relative to the tool so as to promote or urge contact between a workpiece and the fixed jaw of the tool. The edges can be oriented such that they extend at an angle upon placement of the tool on a support surface. In this orientation, a region of the edge proximate the movable jaw is at a height as measured from the support surface that is greater than the height of a region of the edge proximate the fixed jaw. Thus, the resulting orientation of the edge is a downward orientation toward the fixed jaw. Thus, upon placing a circular workpiece upon the edge of the support plates, and depending upon the extent of downward orientation of the edges, gravity causes the workpiece to roll towards and eventually contact the fixed jaw. Therefore, an inclined support plate edge can promote locating a workpiece in contact with the fixed jaw.

Many other benefits will no doubt become apparent from future application and development of this technology.

All patents, published applications, and articles noted herein are hereby incorporated by reference in their entirety.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the disclosure to achieve one or more of the desired objects or results.

Any discussion of documents, acts, materials, devices, articles or the like that has been included in this specification is solely for the purpose of providing a context for the disclosure. It is not to be taken as an admission that any or all of these matters form part of the prior art base or were common general knowledge in the field relevant to the disclosure as it existed anywhere before the priority date of this application.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

Furthermore, any feature or aspect of any of the tools or assemblies described herein can be combined or used with any other feature or aspect of tools or assemblies described herein.

All patents, published applications, and articles noted herein are hereby incorporated by reference in their entirety.

As described hereinabove, the present subject matter solves many problems associated with previous tools, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A tool for selectively gripping a workpiece, the tool comprising:

a handle including a sleeve at one end and an opposite distal end, the sleeve defining a receiving region;

a fixed jaw adjoined to at least one of the sleeve and the handle;

a movable jaw defining a shank, the movable jaw movably disposed in the receiving region defined in the sleeve, the movable jaw defining a threaded region along at least a portion of the shank, the movable jaw positioned relative to the fixed jaw so as to define a workpiece engaging region between the fixed jaw and movable jaw accessible from a front of the tool and rearwardly bounded by the movable jaw;

a rotatable threaded member retained to at least one of the handle and the sleeve, the threaded member threadedly engaged with the threaded region of the movable jaw such that rotation of the threaded member results in linear displacement of the movable jaw relative to the fixed jaw; and at least one lateral support member extending outward from the handle and extending at an angle within a range of 0° to 20° toward a rear of the tool, the rear of the tool being oppositely directed from the workpiece engaging region, wherein the at least one lateral support member includes a first lateral support member extending outward from a first side of the handle and a second lateral support member extending outward from a second side of the handle, the second side being oppositely directed from the first side.

2. The tool of claim 1 wherein the handle defines a longitudinal axis, and the at least one lateral support member extends at an angle within a range of from 90° to 10° relative to the longitudinal axis.

3. The tool of claim 2 wherein the at least one lateral support member extends at an angle of about 60° relative to the longitudinal axis.

4. The tool of claim 1 further comprising:

a first and a second support plate, each support plate engaged with at least one of the sleeve and the fixed jaw, the first support plate positioned adjacent to a first side of the tool and the second support plate positioned adjacent to a second side of the tool, the second side being oppositely directed from the first side, each support plate defining a frontwardly directed edge, wherein the frontwardly directed edges of the first and the second support plates are spaced from a face of the movable jaw that rearwardly bounds the workpiece engaging region.

5. The tool of claim 4 wherein each of the frontwardly directed edges of the first and the second support plates are inclined to thereby promote contact between a workpiece and the fixed jaw.

6. The tool of claim 4 wherein each of the first and the second plates are permanently attached to the sides of the tool.

7. The tool of claim 1 wherein the rotatable threaded member is disposed and accessible along a front region of the handle.

8. The tool of claim 1 wherein the at least one lateral support member is selectively removable from the handle.

9. A tool for selectively gripping a workpiece, the tool comprising:

a handle including a sleeve at one end and an opposite distal end, the sleeve defining a receiving region;

a fixed jaw adjoined to at least one of the sleeve and the handle;

a movable jaw defining a shank, the movable jaw movably disposed in the receiving region defined in the sleeve, the movable jaw defining a threaded region along at least a portion of the shank, the movable jaw positioned relative to the fixed jaw so as to define a workpiece engaging region between the fixed jaw and movable jaw accessible from a front of the tool and rearwardly bounded by the movable jaw;

a rotatable threaded member retained to at least one of the handle and the sleeve, the threaded member threadedly engaged with the threaded region of the movable jaw such that rotation of the threaded member results in linear displacement of the movable jaw relative to the fixed jaw;

a first and a second support plate, each support plate engaged with at least one of the sleeve and the fixed jaw, the first support plate positioned adjacent to a first side of the tool and the second support plate positioned adjacent to a second side of the tool, the second side being oppositely directed from the first side, each support plate defining a frontwardly directed edge, wherein the frontwardly directed edges of the first and the second support plates are spaced from a face of the movable jaw that rearwardly bounds the workpiece engaging region so that a workpiece or pipe contacts the frontwardly directed edges of the first and second support plates instead of the face of the movable jaw when the workpiece is positioned between the fixed jaw and the movable jaw.

10. The tool of claim 9 further comprising:

at least one lateral support member extending outward from the handle and extending at an angle within a range of 0° to 20° toward a rear of the tool.

11. The tool of claim 10 wherein the at least one lateral support member includes a first lateral support member extending outward from a first side of the handle and a second lateral support member extending outward from a second side of the handle, the second side being oppositely directed from the first side.

12. The tool of claim 10 wherein the at least one lateral support member is selectively removable from the handle.

13. The tool of claim 12 further comprising:

provisions for retaining the at least one lateral support member upon removal of the support member from the handle, the provisions adapted to retain the at least one lateral support member alongside the handle and oriented parallel to a longitudinal axis of the handle.

14. The tool of claim 10 wherein the handle defines a longitudinal axis, and the at least one lateral support member extends at an angle within a range of from 90° to 10° relative to the longitudinal axis.

15. The tool of claim 14 wherein the at least one lateral support member extends at an angle of about 60° relative to the longitudinal axis.

16. The tool of claim 9 wherein the rotatable threaded member is disposed and accessible along a front region of the handle.

17. The tool of claim 9 wherein each of the frontwardly directed edges of the first and the second support plates are inclined to thereby promote contact between a workpiece and the fixed jaw.

18. A system selectively configurable between a vise configuration and a wrench configuration, the system comprising:

a tool for selectively gripping a workpiece, the tool including (i) a handle including a sleeve at one end and an opposite distal end, the sleeve defining a receiving region, (ii) a fixed jaw adjoined to at least one of the sleeve and the handle, (iii) a movable jaw defining a shank, the movable jaw movably disposed in the receiving region defined in the sleeve, the movable jaw defining a threaded region along at least a portion of the shank, the movable jaw positioned relative to the fixed jaw so as to define a workpiece engaging region between the fixed jaw and movable jaw accessible from a front of the tool and rearwardly bounded by the movable jaw, (iv) a rotatable threaded member retained to at least one of the handle and the sleeve, the threaded member threadedly engaged with the threaded region of the movable jaw such that rotation of the threaded member results in linear displacement of the movable jaw relative to the fixed jaw, and (v) at least one lateral support member;

wherein upon being configured in a vise configuration the at least one lateral support member is engaged to the handle and extends laterally outward from the handle, and upon being configured in a wrench configuration, the at least one lateral support member is disengaged from the handle.

19. The system of claim 18 wherein upon being configured in a wrench configuration, the at least one lateral support member is stowed alongside the handle and oriented parallel to a longitudinal axis of the handle.

20. The system of claim 19 wherein the handle includes at least one pair of outwardly projecting nubs that releasably retain a lateral support member in a stowed position.

21. The system of claim 19 further comprising:

a flexible member sized to extend about the at least one lateral support member upon placement of the at least one lateral support member in a stowed position.

22. The system of claim 21 wherein the handle defines an aperture and the flexible member extends through the aperture.

23. The system of claim 18 wherein the at least one lateral support member includes a first and a second lateral support member, and the handle includes a first pair of nubs on a first side of the handle and a second pair of nubs on a second side of the handle, each pair of nubs spaced apart from one another.

24. A tool for selectively gripping a workpiece, the tool comprising:

a handle including a sleeve at one end and an opposite distal end, the sleeve defining a receiving region;

a fixed jaw adjoined to at least one of the sleeve and the handle;

a movable jaw defining a shank, the movable jaw movably disposed in the receiving region defined in the sleeve, the movable jaw defining a threaded region along at least a portion of the shank, the movable jaw positioned relative to the fixed jaw so as to define a workpiece engaging region between the fixed jaw and movable jaw accessible from a front of the tool and rearwardly bounded by the movable jaw;

a rotatable threaded member retained to at least one of the handle and the sleeve, the threaded member threadedly engaged with the threaded region of the movable jaw such that rotation of the threaded member results in linear displacement of the movable jaw relative to the fixed jaw; and at least one lateral support member extending outward from the handle and extending at an angle within a range of 0° to 20° toward a rear of the tool, the rear of the tool being oppositely directed from the workpiece engaging region, the at least one lateral support member being disposed at the distal end of the handle.

25. The tool of claim 24 wherein the at least one lateral support member is selectively removable from the handle, the tool further comprising:

provisions for retaining the at least one lateral support member upon removal of the support member from the handle, the provisions adapted to retain the at least one lateral support member alongside the handle and oriented parallel to a longitudinal axis of the handle.

26. The tool of claim 24 wherein the handle further includes a pair of nubs projecting from a side of the handle, the nubs spaced apart from one another a distance corresponding to a length of a lateral support member.

27. The tool of claim 24 further comprising:

a first mounting ear and a second mounting ear, each mounting ear extending laterally outward from at least one of the handle and the sleeve, the first mounting ear extending from a first side of the tool and the second mounting ear extending from a second side of the tool, the second side being oppositely directed from the first side, wherein each mounting ear defines at least one opening extending through the mounting ear.

28. The tool of claim 27 wherein each mounting ear defines a rearwardly directed face and each mounting ear is located relative to the handle and the sleeve such that the rearwardly directed faces of each mounting ear are at least substantially coplanar with rearwardly directed regions of at least one of the handle and the sleeve.

29. A tool for selectively gripping a workpiece, the tool comprising:

a handle including a sleeve at one end and an opposite distal end, the sleeve defining a receiving region;

a fixed jaw adjoined to at least one of the sleeve and the handle;

a movable jaw defining a shank, the movable jaw movably disposed in the receiving region defined in the sleeve, the movable jaw defining a threaded region along at least a portion of the shank, the movable jaw positioned relative to the fixed jaw so as to define a workpiece engaging region between the fixed jaw and movable jaw accessible from a front of the tool and rearwardly bounded by the movable jaw;

a rotatable threaded member retained to at least one of the handle and the sleeve, the threaded member threadedly engaged with the threaded region of the movable jaw such that rotation of the threaded member results in linear displacement of the movable jaw relative to the fixed jaw;

a first and a second support plate, each support plate engaged with at least one of the sleeve and the fixed jaw, the first support plate positioned adjacent to a first side of the tool and the second support plate positioned adjacent to a second side of the tool, the second side being oppositely directed from the first side, each support plate defining a frontwardly directed edge, wherein the frontwardly directed edges of the first and the second support plates are spaced from a face of the movable jaw that rearwardly bounds the workpiece engaging region;

wherein the handle further includes a pair of nubs projecting from a side of the handle, the nubs spaced apart from one another a distance corresponding to a length of a lateral support member.

30. The tool of claim 29 further comprising:

a first and a second mounting ear, each ear extending laterally outward from at least one of the handle and the sleeve, the first ear extending from a first side of the tool and the second ear extending from a second side of the tool, the second side being oppositely directed from the first side, wherein each ear defines at least one opening extending through the ear.

31. The tool of claim 30 wherein each ear defines a rearwardly directed face and each ear is located relative to the handle and the sleeve such that the rearwardly directed faces of each ear are at least substantially coplanar with rearwardly directed regions of at least one of the handle and the sleeve.

32. The tool of claim 29 further comprising at least one lateral support member extending outward from the handle and extending at an angle within a range of 0° to 20° toward a rear of the tool, wherein the at least one lateral support member is disposed at the distal end of the handle.

* * * * *